US011674695B2

(12) United States Patent
Sakaguchi et al.

(10) Patent No.: US 11,674,695 B2
(45) Date of Patent: Jun. 13, 2023

(54) HOT WATER SUPPLY APPARATUS

(71) Applicant: DAIKIN INDUSTRIES, LTD., Osaka (JP)

(72) Inventors: Hideho Sakaguchi, Osaka (JP); Atsushi Okamoto, Osaka (JP); Masanori Ukibune, Osaka (JP); Yasuhiro Kouno, Osaka (JP); Yurika Gotou, Osaka (JP); Qi Fang, Osaka (JP); Tim Coessens, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/718,852

(22) Filed: Apr. 12, 2022

(65) Prior Publication Data

US 2022/0235945 A1 Jul. 28, 2022

Related U.S. Application Data

(63) Continuation of application No. PCT/JP2020/041062, filed on Nov. 2, 2020.

(30) Foreign Application Priority Data

Nov. 5, 2019 (JP) ..... JP2019-200695

(51) Int. Cl.
*F24D 19/00* (2006.01)
*F24D 17/02* (2006.01)
(Continued)

(52) U.S. Cl.
CPC ..... *F24D 19/0092* (2013.01); *F24D 3/18* (2013.01); *F24D 17/02* (2013.01); *F24D 19/1054* (2013.01); *F24H 15/288* (2022.01)

(58) Field of Classification Search
CPC .. F24D 19/0092; F24D 19/1054; F24D 17/02; F24D 3/18; F24H 15/288
(Continued)

(56) References Cited

U.S. PATENT DOCUMENTS 2,259,644 A * 10/1941 Kling ..... B08B 9/0326 134/22.12
5,429,077 A * 7/1995 Moskal ..... F22B 37/48 165/95
(Continued)

FOREIGN PATENT DOCUMENTS

EP 2 360 442 A1 8/2011
EP 2 469 197 A1 6/2012
(Continued)

OTHER PUBLICATIONS

Decision to Grant a Patent issued in Japanese Application No. 2019-200695, dated Jun. 9, 2021.
(Continued)

*Primary Examiner* — Steven B McAllister
*Assistant Examiner* — Daniel E. Namay
(74) *Attorney, Agent, or Firm* — Birch, Stewart, Kolasch & Birch, LLP

(57) ABSTRACT

A controller performs a first operation in which a heat source device directly or indirectly heats water in a first channel of a heat exchanger and a second operation in which the heat source device directly or indirectly cools the water in the first channel of the heat exchanger after the first operation ends.

20 Claims, 13 Drawing Sheets

(51) Int. Cl.
*F24D 19/10* (2006.01)
*F24H 15/288* (2022.01)
*F24D 3/18* (2006.01)

(58) Field of Classification Search
USPC ..... 237/2 R, 2 B, 8 R, 8 A; 122/402, 379
See application file for complete search history.

(56) References Cited

U.S. PATENT DOCUMENTS

| | | | | |
|---|---|---|---|---|
| 6,755,156 | B1 * | 6/2004 | Zilka | F27D 1/1694 102/302 |
| 2003/0034149 | A1 * | 2/2003 | Harrison | F28D 20/0039 165/101 |
| 2004/0112812 | A1 * | 6/2004 | Kawabe | C02F 5/025 210/243 |
| 2016/0010890 | A1 * | 1/2016 | Suzuki | F24D 19/0092 62/160 |
| 2017/0047741 | A1 * | 2/2017 | Narla | H02J 3/00 |

FOREIGN PATENT DOCUMENTS

| | | | | | |
|---|---|---|---|---|---|
| EP | 2 980 584 | A1 | | 2/2016 | |
| EP | 3 306 221 | A2 | | 4/2018 | |
| JP | 2002-228258 | A | | 8/2002 | |
| JP | 2006-275445 | A | | 10/2006 | |
| JP | 2011-58801 | A | | 3/2011 | |
| JP | 2011058801 | A | * | 3/2011 | |
| JP | 2011-69572 | A | | 4/2011 | |
| JP | 2011069572 | A | * | 4/2011 | C02F 5/025 |
| JP | 2015-124909 | A | | 7/2015 | |
| JP | 2016-90093 | A | | 5/2016 | |
| JP | 2016-211798 | A | | 12/2016 | |
| JP | 2019200695 | A | * | 11/2019 | F17C 3/085 |
| WO | WO-2011037055 | A1 | * | 3/2011 | C02F 5/025 |
| WO | WO-2015052443 | A1 | * | 4/2015 | B08B 9/0321 |
| WO | WO-2021090806 | A1 | * | 5/2021 | F24D 17/02 |

OTHER PUBLICATIONS

International Search Report (PCT/ISA/210) issued in PCT/JP2020/041062, dated Dec. 8, 2020.
Notice of Reasons for Refusal issued in Japanese Application No. 2019-200695, dated Mar. 1, 2021.
Written Opinion of the International Searching Authority (PCT/ISA/237) issued in PCT/JP2020/041062, dated Dec. 8, 2020.
International Preliminary Report on Patentability and English translation of the Written Opinion of the International Searching Authority dated May 19, 2022 for Application No. PCT/JP2020/041062.
Extended European Search Report for European Application No. 20885660.9, dated Nov. 7, 2022.

* cited by examiner

HEATING OPERATION

COOLING OPERATION

COOLING OPERATION (NORMAL ACTION)

COOLING OPERATION (BYPASS ACTION)

COOLING OPERATION (NORMAL ACTION)

COOLING OPERATION (BYPASS ACTION)

COOLING OPERATION (NORMAL ACTION)

COOLING OPERATION (MEDIUM-TEMPERATURE WATER RETURNING ACTION)

COOLING OPERATION (BYPASS ACTION)

COOLING OPERATION (NORMAL ACTION)

COOLING OPERATION (LOW-TEMPERATURE WATER RETURNING ACTION)

COOLING OPERATION (PUMP STOP ACTION)

HEATING OPERATION

COOLING OPERATION

HEATING OPERATION

COOLING OPERATION

HOT WATER SUPPLY APPARATUS

CROSS REFERENCE TO RELATED APPLICATIONS

This application is a Continuation of PCT International Application No. PCT/JP2020/041062, filed on Nov. 2, 2020, which claims priority under 35 U.S.C. 119(a) to Patent Application No. 2019-200695, filed in Japan on Nov. 5, 2019, all of which are hereby expressly incorporated by reference into the present application.

TECHNICAL FIELD

The present disclosure relates to a hot water supply apparatus.

BACKGROUND ART

A hot water supply apparatus that heats water in a tank with a heat exchanger and stores the heated water in the tank has been known. A hot water supply apparatus of Patent Document 1 heats the water with the heat exchanger, and then replaces the water in a water circuit (anti-scale operation). For the anti-scale operation, the water in the water circuit between the heat exchanger and the tank is replaced with low-temperature water in the tank. As a result, the temperature of the water present between the heat exchanger and the tank is lowered. This can block the generation of scale (e.g., calcium carbonate) from the water.

CITATION LIST

Patent Document

Patent Document 1: Japanese Unexamined Patent Publication No. 2006-275445

SUMMARY

A first aspect is directed to a hot water supply apparatus including: a heat source device (20); a tank (40) configured to store water; a water circuit (50) through which the water in the tank (40) circulates; a heat exchanger (25) having a first channel (25*a*) connected to the water circuit (50); and a controller (80) configured to control the heat source device (20) and the water circuit (50), wherein the controller (80) is configured to perform: a first operation in which the heat source device (20) directly or indirectly heats the water in the first channel (25*a*) of the heat exchanger (25); and a second operation in which the heat source device (20) directly or indirectly cools the water in the first channel (25*a*) of the heat exchanger (25) after the first operation ends.

DESCRIPTION OF EMBODIMENTS

Embodiments of the present disclosure will be described below with reference to the drawings. The following embodiments are merely exemplary ones in nature, and are not intended to limit the scope, applications, or use of the present invention.

First Embodiment

Figure 1:
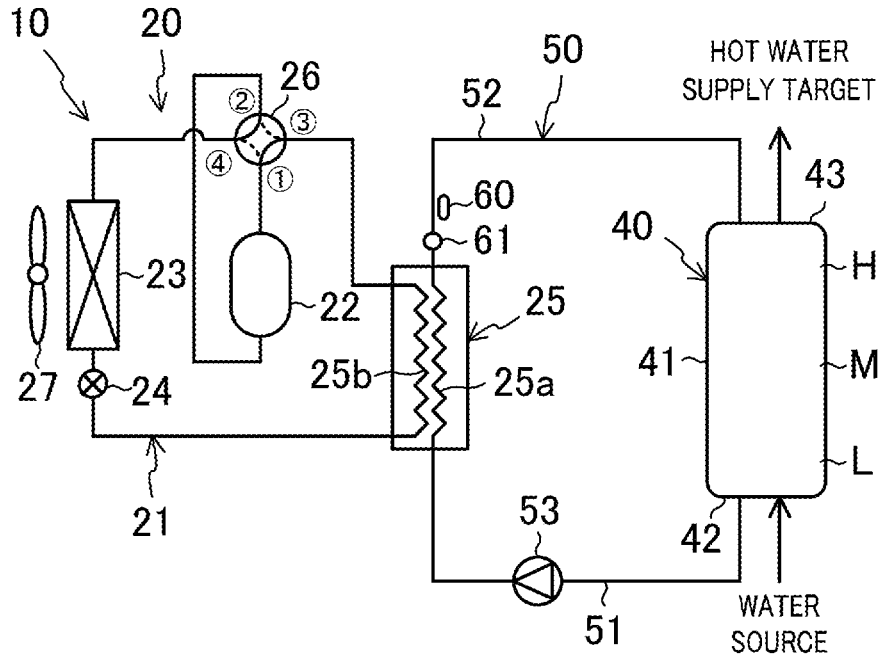
FIG. 1 is a schematic piping system diagram of a hot water supply apparatus according to a first embodiment.
Figure 2:
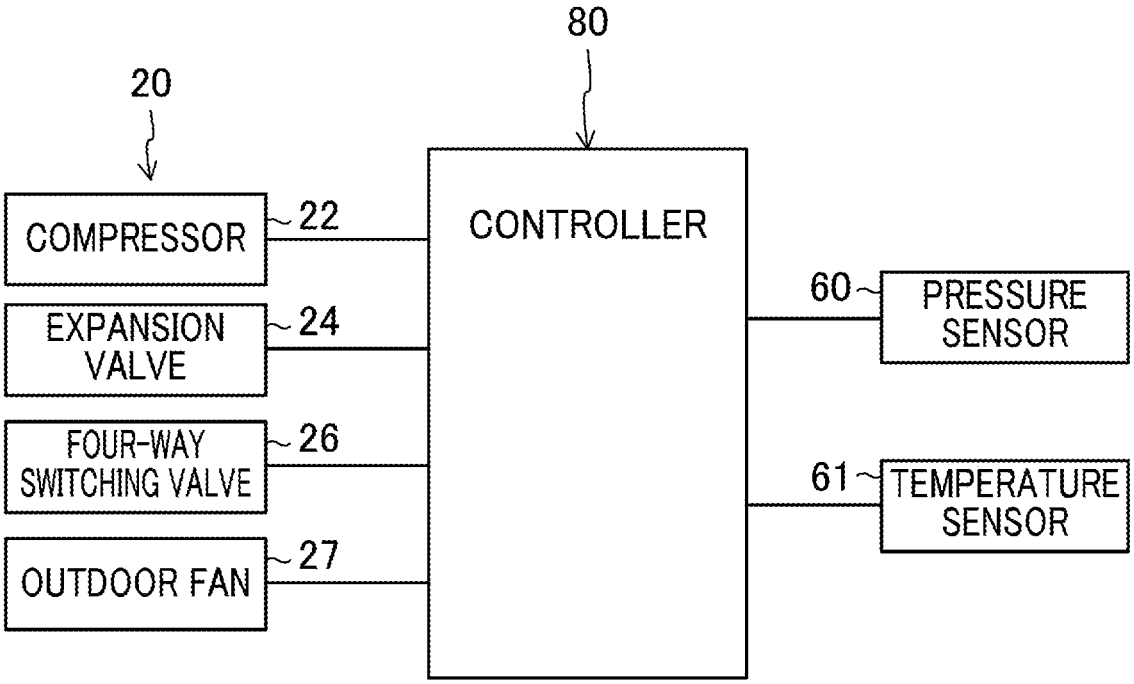
FIG. 2 is a block diagram illustrating relationship between a controller according to the first embodiment and its peripheral devices.

The present disclosure is directed to a hot water supply apparatus (10). The hot water supply apparatus (10) heats water supplied from a water source, and stores the heated water in a tank (40). The hot water stored in the tank (40) is supplied to a predetermined hot water supply target. The water source includes a water supply system. The hot water supply target includes a shower, a faucet, and a bathtub. As illustrated in FIGS. 1 and 2, the hot water supply apparatus (10) includes a heat source device (20), the tank (40), a water circuit (50), a pressure sensor (60), a temperature sensor (61), and a controller (80).

<Heat Source Device>

The heat source device (20) of this embodiment is, for example, a heat pump heat source device. The heat source device (20) produces warm thermal energy for heating water and so-called cold thermal energy for cooling water. The heat source device (20) is a vapor compression heat source device. The heat source device (20) includes a refrigerant circuit (21). The refrigerant circuit (21) is filled with a refrigerant. The refrigerant circuit (21) includes a compressor (22), a heat source heat exchanger (23), an expansion valve (24), a utilization heat exchanger (25), and a four-way switching valve (26).

The compressor (22) sucks and compresses a refrigerant and discharges the compressed refrigerant.

The heat source heat exchanger (23) is an air-cooled heat exchanger. The heat source heat exchanger (23) is disposed outdoors. The heat source device (20) includes an outdoor fan (27). The outdoor fan (27) is arranged near the heat source heat exchanger (23). The heat source heat exchanger (23) exchanges heat between the air conveyed by the outdoor fan (27) and the refrigerant.

The expansion valve (24) is a decompression mechanism that decompresses the refrigerant. The expansion valve (24) is provided between a liquid end of the utilization heat exchanger (25) and a liquid end of the heat source heat exchanger (23). The decompression mechanism is not limited to an expansion valve, and may be other mechanisms, such as a capillary tube and an expander. The expander recovers the energy of the refrigerant as power.

The utilization heat exchanger (25) corresponds to a heat exchanger. The utilization heat exchanger (25) is a liquid-cooled heat exchanger. The utilization heat exchanger (25) has a first channel (25*a*) and a second channel (25*b*). The second channel (25*b*) is connected to the refrigerant circuit (21). The first channel (25*a*) is connected to the water circuit (50). The utilization heat exchanger (25) exchanges heat between water flowing through the first channel (25*a*) and the refrigerant flowing through the second channel (25*b*).

The first channel (25*a*) is formed along the second channel (25*b*) in the utilization heat exchanger (25). In this embodiment, the refrigerant in the second channel (25*b*) flows in a direction substantially opposite to the water flowing through the first channel (25*a*) during a heating operation which will be described later in detail. That is, the utilization heat exchanger (25) functions as a countercurrent heat exchanger during the heating operation.

The four-way switching valve (26) corresponds to a switching mechanism for switching between a first refrigeration cycle and a second refrigeration cycle. The four-way switching valve (26) has a first port (1), a second port (2), a third port (3), and a fourth port (4). The first port (1) of the four-way switching valve (26) is connected to the discharge side of the compressor (22). The second port (2) of the four-way switching valve (26) is connected to the suction side of the compressor (22). The third port (3) of the four-way switching valve (26) is connected to a gas end of the second channel (25*b*) of the utilization heat exchanger (25). The fourth port (4) of the four-way switching valve (26) is connected to a gas end of the heat source heat exchanger (23). The four-way switching valve (26) switches between a first state indicated by solid curves in FIG. 1 and a second state indicated by broken curves in FIG. 1. The four-way switching valve (26) in the first state makes the first and third ports (1), (3) communicate with each other, and makes the second and fourth ports (2), (4) communicate with each other. The four-way switching valve (26) in the second state makes the first and fourth ports (1), (4) communicate with each other, and makes the second and third ports (2), (3) communicate with each other.

<Tank and Water Circuit>

The tank (40) is a container for storing water. The tank (40) is formed in a vertically long cylindrical shape. The tank (40) has a cylindrical barrel (41), a bottom (42) closing a lower end of the barrel (41), and a top (43) closing an upper end of the barrel (41). The tank (40) has a low-temperature portion (L), a medium-temperature portion (M), and a high-temperature portion (H). The low-temperature portion (L) stores low-temperature water. The high-temperature portion (H) stores high-temperature water. The medium-temperature portion (M) stores medium-temperature water. The medium-temperature water is cooler than the high-temperature water and hotter than the low-temperature water.

The water in the tank (40) circulates in the water circuit (50). The first channel (25*a*) of the utilization heat exchanger (25) is connected to the water circuit (50). The water circuit (50) includes an upstream channel (51) and a downstream channel (52). An inflow end of the upstream channel (51) is connected to the bottom (42) of the tank (40). The inflow end of the upstream channel (51) is connected to the low-temperature portion (L) of the tank (40). An outflow end of the upstream channel (51) is connected to an inflow end of the first channel (25*a*). An inflow end of the downstream channel (52) is connected to an outflow end of the first channel (25*a*). An outflow end of the downstream channel (52) is connected to the top of the tank (40).

The upstream channel (51) corresponds to a supply unit that supplies the low-temperature water to the first channel (25*a*) of the utilization heat exchanger (25) in the cooling operation.

The water circuit (50) has a water pump (53). The water pump (53) circulates the water in the water circuit (50). The water pump (53) corresponds to a first pump. The water pump (53) conveys the water in the tank (40) to the first channel (25*a*) of the utilization heat exchanger (25). The water pump (53) conveys the water to the first channel (25*a*) and sends the water to the tank (40).

<Pressure Sensor>

The water circuit (50) is provided with a pressure sensor (60). The pressure sensor (60) is a pressure detector that detects the pressure of the water in the water circuit (50). The pressure sensor (60) detects the pressure of the water in the first channel (25*a*) or the pressure of the water in the downstream channel (52).

<Temperature Sensor>

The water circuit (50) is provided with a temperature sensor (61). The temperature sensor (61) is a temperature detector that detects the temperature of the water in the water circuit (50). The temperature sensor (61) detects the temperature of the water in the first channel (25*a*) or the temperature of the water in the downstream channel (52).

The temperature sensor (61) may directly detect the temperature of the water in the water circuit (50). The temperature sensor (61) may be attached to the surface of a pipe forming the water circuit (50) to indirectly detect the temperature of the water in the water circuit (50) via the pipe.

<Controller>

The controller (80) shown in FIG. 2 includes a microcomputer and a memory device (specifically, a semiconductor memory) that stores software for operating the microcomputer. The controller (80) controls the heat source device (20) and the components of the water circuit (50). The components of the water circuit (50) include the water pump (53).

The controller (80) is connected to the heat source device (20), the temperature sensor (61), and the pressure sensor (60) via wires. Signals are exchanged between these components and the controller (80).

The controller (80) allows execution of a heating operation corresponding to the first operation and a cooling operation corresponding to the second operation. In the heating operation, hot water is generated and stored in the tank (40). The heating operation of this embodiment is an operation in which the heat source device (20) directly heats the water. The cooling operation is performed to remove scale from the water circuit (50). The cooling operation is an operation in which the heat source device (20) directly cools the water in the first channel (25*a*) of the utilization heat exchanger (25).

The controller (80) performs a first determination and a second determination. The first determination is performed in the course of the heating operation to determine whether to perform the cooling operation according to the amount of the scale in the water circuit (50). The second determination is performed in the course of the cooling operation to determine whether to end the cooling operation according to the amount of the scale in the water circuit (50). Details of the determinations will be described later.

—Operation—The hot water supply apparatus (10) performs the heating operation and the cooling operation.

<Heating Operation>

Figure 3:
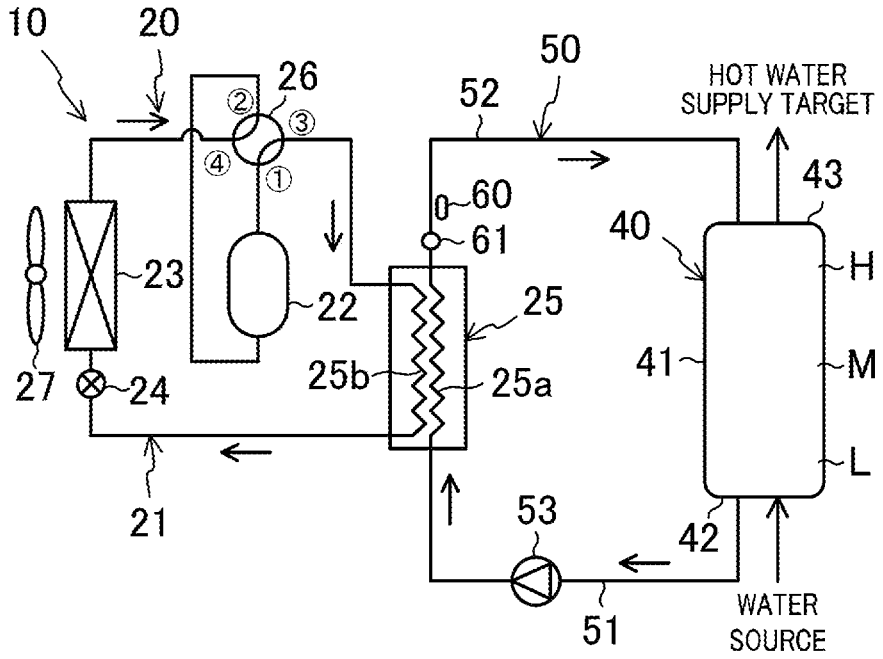
FIG. 3 is a schematic piping system diagram of the hot water supply apparatus according to the first embodiment performing a heating operation.

In the heating operation shown in FIG. 3, the controller (80) operates the compressor (22) and the outdoor fan (27). The controller (80) sets the four-way switching valve (26) to the first state. The controller (80) appropriately adjusts the opening degree of the expansion valve (24). The controller (80) operates the water pump (53).

The heat source device (20) performs the first refrigeration cycle. In the first refrigeration cycle, the refrigerant dissipates heat in the utilization heat exchanger (25). More specifically, the refrigerant compressed by the compressor (22) flows through the second channel (25*b*) of the utilization heat exchanger (25) in the first refrigeration cycle. In the utilization heat exchanger (25), the refrigerant in the second channel (25*b*) dissipates heat to the water in the first channel (25*a*). The refrigerant that has dissipated heat or condensed in the second channel (25*b*) is decompressed by the expansion valve (24), and then flows through the heat source heat exchanger (23). In the heat source heat exchanger (23), the refrigerant absorbs heat from the outdoor air and evaporates. The refrigerant that has evaporated in the heat source heat exchanger (23) is sucked into the compressor (22).

In the water circuit (50), the water in the low-temperature portion (L) of the tank (40) flows into the upstream channel (51). The water in the upstream channel (51) flows through the first channel (25*a*) of the utilization heat exchanger (25). The water in the first channel (25*a*) is heated by the refrigerant in the heat source device (20). The water heated in the first channel (25*a*) flows through the downstream channel (52) and enters the high-temperature portion (H) of the tank (40).

<Cooling Operation>

Figure 4:
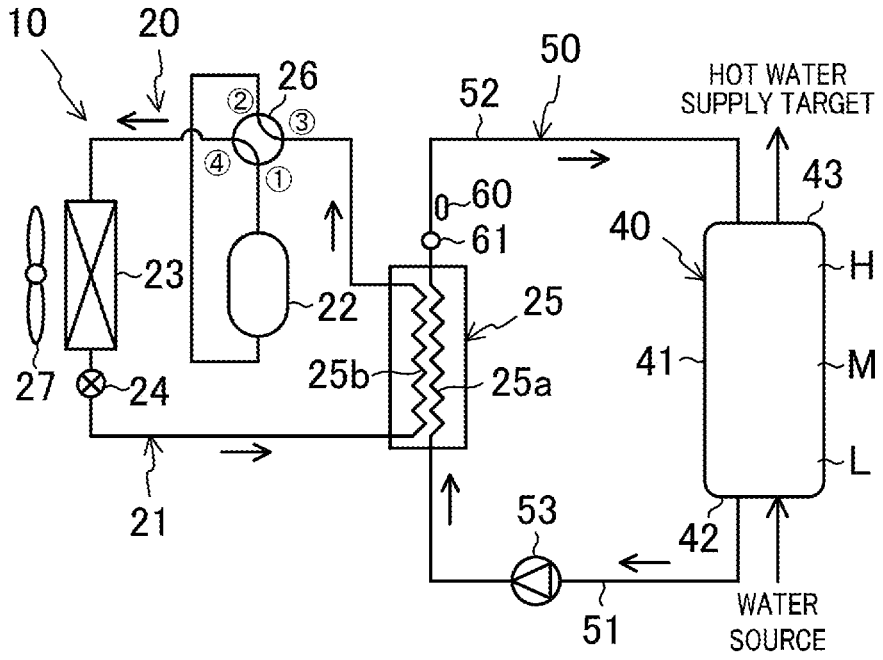
FIG. 4 is a schematic piping system diagram of the hot water supply apparatus according to the first embodiment performing a cooling operation.

The cooling operation shown in FIG. 4 is performed after the heating operation ends. In the cooling operation, the controller (80) operates the compressor (22) and the outdoor fan (27). The controller (80) sets the four-way switching valve (26) to the second state. The controller (80) appropriately adjusts the opening degree of the expansion valve (24). The controller (80) operates the water pump (53).

The heat source device (20) performs the second refrigeration cycle. In the second refrigeration cycle, the refrigerant evaporates in the utilization heat exchanger (25). More specifically, the refrigerant compressed by the compressor (22) flows through the heat source heat exchanger (23) in the second refrigeration cycle. In the utilization heat exchanger (25), the refrigerant dissipates heat to the outdoor air. The refrigerant that has dissipated heat or condensed in the heat source heat exchanger (23) is decompressed by the expansion valve (24), and then flows through the second channel (25*b*) of the utilization heat exchanger (25). The refrigerant in the second channel (25*b*) of the utilization heat exchanger (25) absorbs heat from the water in the first channel (25*a*) to evaporate. The refrigerant evaporated in the utilization heat exchanger (25) is sucked into the compressor (22).

In the water circuit (50), the water in the low-temperature portion (L) of the tank (40) flows into the upstream channel (51). The water in the upstream channel (51) flows through the first channel (25*a*) of the utilization heat exchanger (25). The water in the first channel (25*a*) is cooled by the refrigerant in the heat source device (20). The water cooled in the first channel (25*a*) flows through the downstream channel (52) and enters the high-temperature portion (H) of the tank (40).

In the cooling operation, the refrigerant in the heat source device (20) cools the water in the first channel (25*a*) of the utilization heat exchanger (25). This can quickly drop the temperature of the water in the first channel (25*a*) to a precipitation temperature or lower. The precipitation temperature referred to herein is a temperature at which the scale such as calcium carbonate precipitates out of water. The temperature drop can keep the scale from precipitating in the first channel (25*a*) of the utilization heat exchanger (25). In addition, the precipitated scale can be quickly dissolved in water.

When the heating operation is switched to the cooling operation, the temperature of the utilization heat exchanger (25) greatly drops. This temperature drop can cause thermal contraction of the utilization heat exchanger (25). The thermal contraction can peel the scale off the inner wall of the first channel (25*a*) of the utilization heat exchanger (25).

In the cooling operation, the water pump (53) operates. Thus, the water cooled in the first channel (25*a*) flows through the downstream channel (52). This can lower the temperature of the water in the downstream channel (52), keeping the scale from precipitating in the downstream channel (52). When the water pump (53) operates, the low-temperature water in the low-temperature portion (L) is sent to the first channel (25*a*). The low-temperature water can lower the temperature of the water in the first channel (25*a*).

—Determination—The controller (80) performs a first determination and a second determination.

<First Determination>

Figure 5:
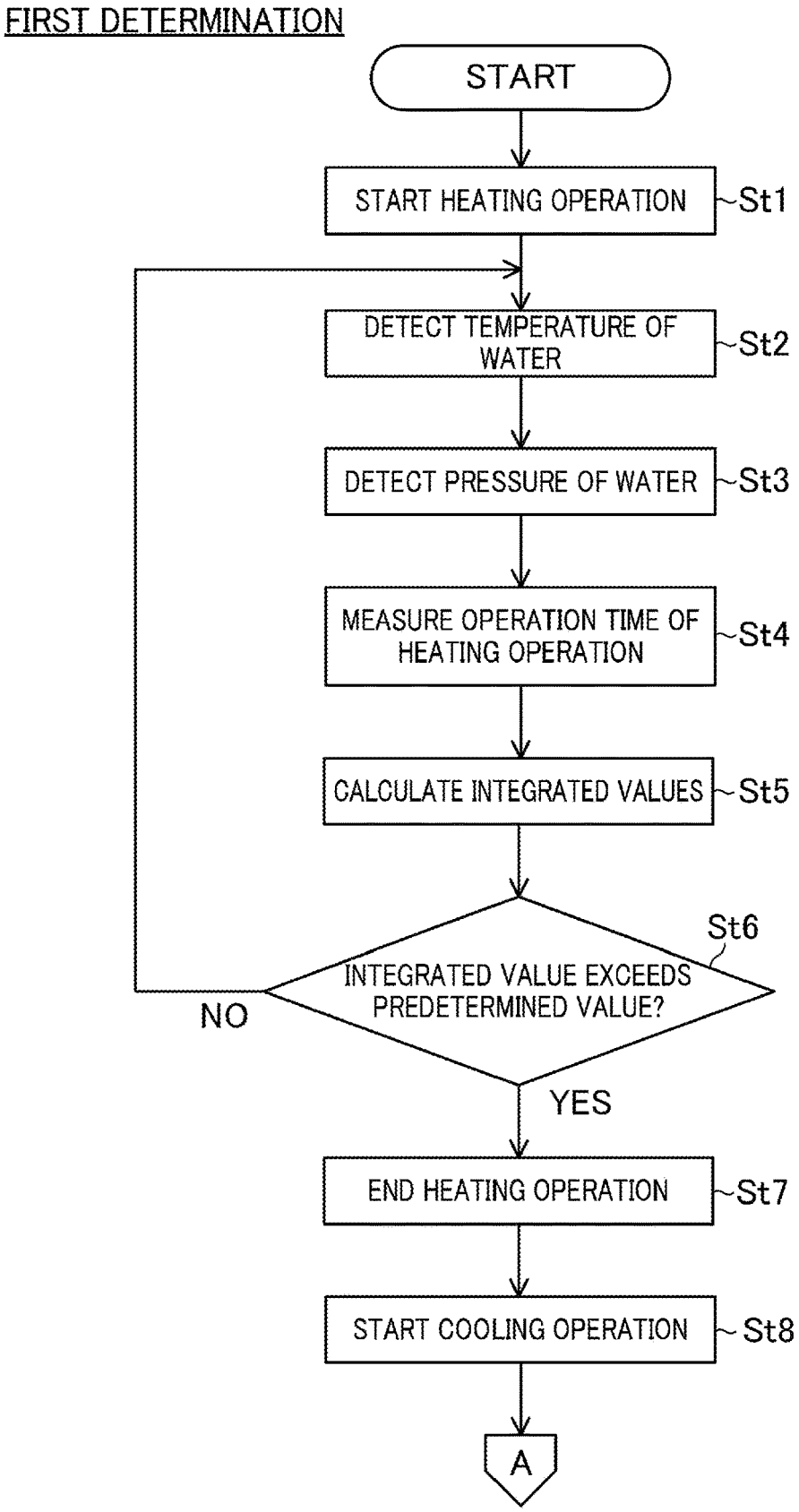
FIG. 5 is a flowchart of a first determination of the hot water supply apparatus according to the first embodiment.

The first determination shown in FIG. 5 is performed in the course of the heating operation to determine whether to perform the cooling operation. In Step St1, the heating operation starts. In Step St2, the temperature sensor (61) detects the temperature Tw of the water in the water circuit (50). In Step St3, the pressure sensor (60) detects the pressure Pw of the water in the water circuit (50). In Step St4, a time measurement unit of the controller (80) measures operation time ΔT1 of the heating operation. In Step St5, a calculation unit of the controller (80) calculates an integrated value I based on the temperature Tw, the pressure Pw, and the operation time ΔT1. The integrated value I is an index for estimating the amount of scale in the water. This is because the scale amount in the water varies depending on the temperature and pressure of the water and the operation time of the first operation. It can be estimated that the scale amount in the water circuit (50) increases as the integrated value I increases.

In Step St6, the controller (80) determines whether the integrated value I exceeds a predetermined value. If the integrated value I exceeds the predetermined value, the controller (80) ends the heating operation in Step St7. If the integrated value I does not exceed the predetermined value, the processing of Steps St2 to St5 is performed. When the heating operation ends in Step St7, the controller (80) starts the cooling operation in Step St8.

<Second Determination>

Figure 6:
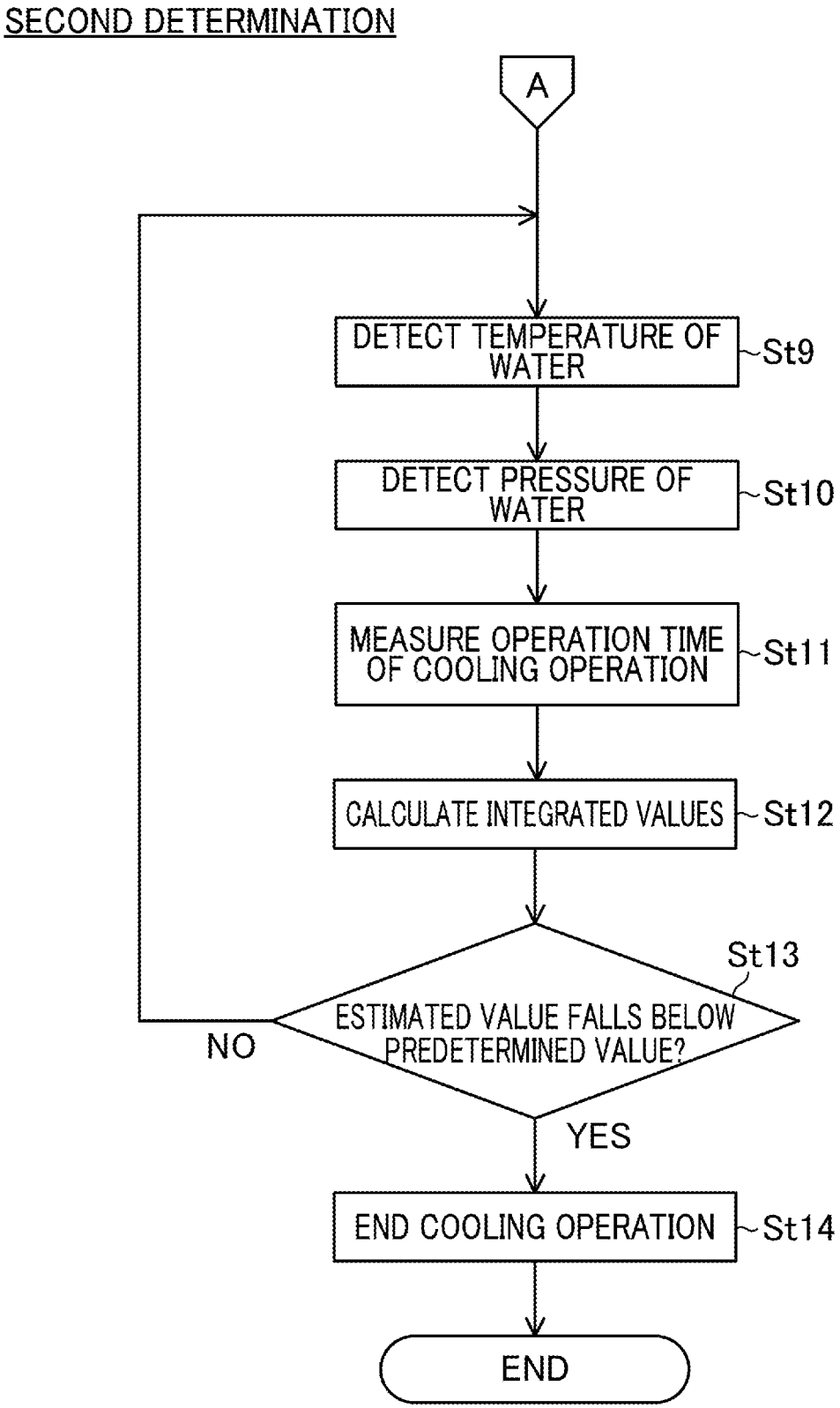
FIG. 6 is a flowchart of a second determination of the hot water supply apparatus according to the first embodiment.

The second determination shown in FIG. 6 is performed in the course of the cooling operation to determine whether to end the cooling operation. After the cooling operation starts, the temperature sensor (61) detects the temperature Tw of the water in the water circuit (50) in Step St9. In Step St10, the pressure sensor (60) detects the pressure Pw of the water in the water circuit (50). In Step St11, the time measurement unit of the controller (80) measures operation time ΔT2 of the cooling operation. In Step St12, the calculation unit of the controller (80) calculates a value (estimated value A) based on the temperature Tw, the pressure Pw, and the operation time ΔT. The estimated value A is an index for estimating the amount of scale in the water. This is because the scale amount in the water varies depending on the temperature and pressure of the water and the operation time of the second operation. It can be estimated that the scale amount in the water circuit (50) increases as the estimated value A increases.

In Step St13, the controller (80) determines whether the estimated value A falls below a predetermined value. If the estimated value falls below the predetermined value, the controller (80) ends the cooling operation in Step St14. If the estimated value A does not fall below the predetermined value, the processing of Steps St9 to St12 is performed.

Advantages of First Embodiment

As a first feature of the first embodiment, the hot water supply apparatus includes: a heat source device (20); a tank (40) configured to store water; a water circuit (50) through which the water in the tank (40) circulates; a heat exchanger (25) having a first channel (25*a*) connected to the water circuit (50); and a controller (80) configured to control the heat source device (20) and the water circuit (50), wherein the controller (80) is configured to perform: a first operation in which the heat source device (20) directly or indirectly heats the water in the first channel (25*a*) of the heat exchanger (25); and a second operation in which the heat source device (20) directly or indirectly cools the water in the first channel (25*a*) of the heat exchanger (25) after the first operation ends.

According to the first feature of the first embodiment, the heat source device (20) cools the water in the first channel (25*a*) in the cooling operation which is the second operation. Thus, the temperature of the water in the first channel (25*a*) can be lowered more quickly than in a known operation in which the low-temperature water is supplied to the first channel (25*a*). This can keep the scale from precipitating from the water in the first channel (25*a*). In addition, the scale in the first channel (25*a*) can be quickly dissolved in water.

According to the first feature of the first embodiment, the utilization heat exchanger (25) can be thermally contracted when the heating operation is switched to the cooling operation. The thermal contraction can peel the scale off the inner wall of the first channel (25*a*). This can keep the heat transfer performance of the heat exchanger (25) from decreasing due to adhesion of the scale.

In the first embodiment, the heat source device (20) directly cools the water in the first channel (25*a*). This can quickly cool the water in the first channel (25*a*).

In the first embodiment, the refrigerant causing the vapor compression refrigeration cycle cools the water in the first channel (25*a*). This can quickly cool the water in the first channel (25*a*).

As a second feature of the first embodiment, the controller (80) performs a first determination of whether to perform the second operation according to an amount of scale in the water circuit (50) in the course of the first operation.

According to the second feature of the first embodiment, the controller (80) can perform the cooling operation only in a situation where the scale amount has increased. This can keep the amount of heat of hot water in the tank (40) from lacking due to an excessive cooling operation. If the scale amount increases, the cooling operation can be performed to quickly remove the scale.

As a third feature of the first embodiment, whether to perform the second operation is determined in the first determination based on at least the integrated value of the operation time of the first operation.

According to the third feature of the first embodiment, the controller (80) can easily estimate the scale amount in the water circuit (50), and can easily determine whether to perform the cooling operation.

As a fourth feature of the first embodiment, the controller (80) performs the second operation when it is determined in the first determination that an integrated value, which is based on the operation time of the first operation, a temperature of the water in the water circuit (50), and a pressure of the water in the water circuit (50), exceeds a predetermined value.

According to the fourth feature of the first embodiment, the controller (80) can accurately estimate the scale amount in the water circuit (50). Thus, the controller (80) can perform the cooling operation in a situation where the actual amount of scale is large.

As a fifth feature of the first embodiment, the controller (80) performs a second determination of whether to end the second operation according to an amount of scale in the water circuit (50) in the course of the second operation.

According to the fifth feature of the first embodiment, the controller (80) can end the cooling operation in a situation where the scale amount has decreased. This can keep the amount of heat of hot water in the tank (40) from lacking due to an excessive cooling operation.

As a sixth feature of the first embodiment, the controller (80) determines in the second determination whether to end the second operation based on at least the operation time of the second operation.

According to the sixth feature of the first embodiment, the controller (80) can easily estimate the scale amount in the water circuit (50), and can easily determine whether to end the cooling operation.

As a seventh feature of the first embodiment, the controller (80) is configured to end the second operation when it is determined in the second determination that a value, which is based on the operation time of the second operation, a temperature of the water in the water circuit (50), and a pressure of the water in the water circuit (50), falls below a predetermined value.

According to the seventh feature of the first embodiment, the controller (80) can accurately estimate the scale amount in the water circuit (50). Thus, the controller (80) can end the cooling operation after the actual scale is reliably removed.

As an eighth feature of the first embodiment, the hot water supply apparatus further includes the supply unit (51, 63) configured to supply the low-temperature water to the first channel (25*a*) of the heat exchanger (25) in the second operation.

According to the eighth feature of the first embodiment, the upstream channel (51), which is the supply unit, supplies the low-temperature water in the tank (40) to the first channel (25*a*) of the utilization heat exchanger (25) in the second operation. This can quickly lower the temperature of the water in the first channel (25*a*). Further, the temperature of the water in the downstream channel (52) can be quickly lowered.

Second Embodiment

A water circuit (50) of a hot water supply apparatus (10) of a second embodiment is different from the water circuit (50) of the first embodiment. Thus, differences from the first embodiment will be mainly described below.

Figure 7:
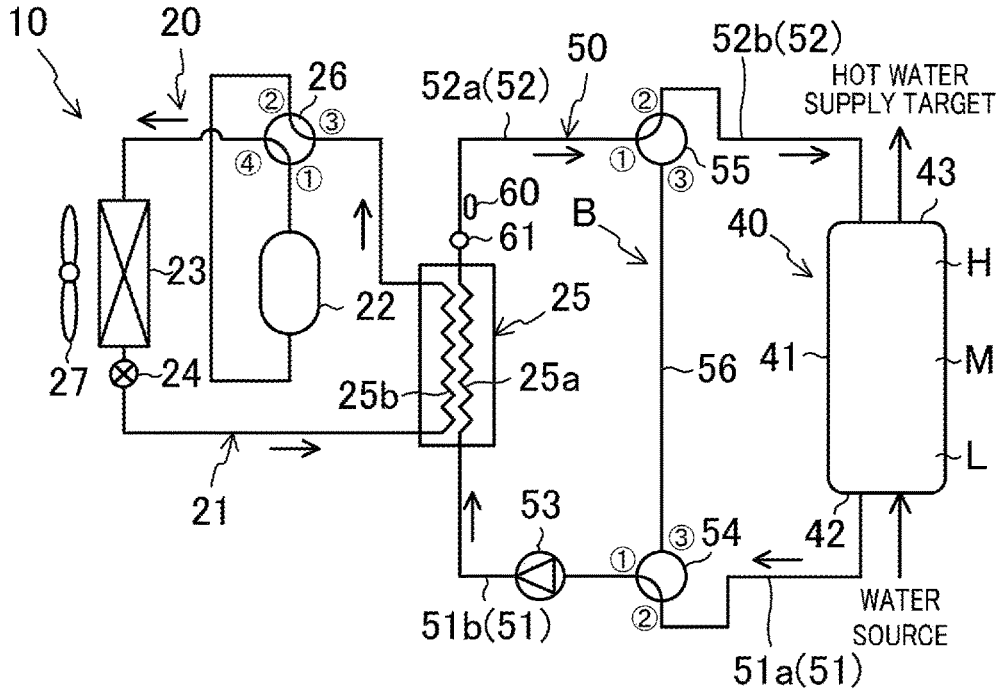
FIG. 7 is a schematic piping system diagram of a hot water supply apparatus according to a second embodiment performing a normal action of the cooling operation.
Figure 8:
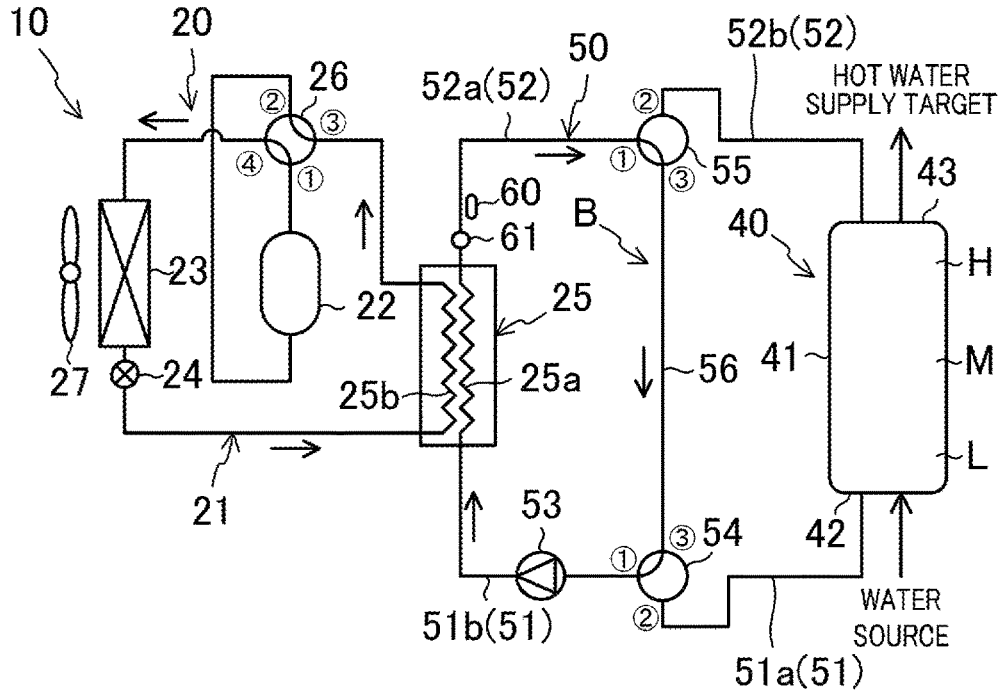
FIG. 8 is a schematic piping system diagram of the hot water supply apparatus according to the second embodiment performing a bypass action of the cooling operation.

As illustrated in FIGS. 7 and 8, the water circuit (50) includes a first three-way valve (54), a second three-way valve (55), and a bypass channel (56). The first three-way valve (54), the second three-way valve (55), and the bypass channel (56) constitute a bypass section (B). The bypass section (B) forms a channel through which water cooled in the first channel (25*a*) of the utilization heat exchanger (25) bypasses the tank (40) and returns to the first channel (25*a*) in the cooling operation.

The upstream channel (51) includes a first upstream channel (51*a*) and a second upstream channel (51*b*). The downstream channel (52) includes a first downstream channel (52*a*) and a second downstream channel (52*b*).

Each of the first three-way valve (54) and the second three-way valve (55) has a first port (1), a second port (2), and a third port (3). The first port (1) of the first three-way valve (54) is connected to the first channel (25*a*) via the second upstream channel (51*b*). The second port (2) of the first three-way valve (54) is connected to the low-temperature portion (L) of the tank (40) via the first upstream channel (51*a*). The third port (3) of the first three-way valve (54) is connected to an outflow end of the bypass channel (56). The first port (1) of the second three-way valve (55) is connected to the first channel (25*a*) via the first downstream channel (52*a*). The second port (2) of the second three-way valve (55) is connected to the high-temperature portion (H) of the tank (40) via the second downstream channel (52*b*). The third port (3) of the second three-way valve (55) is connected to an inflow end of the bypass channel (56).

The first three-way valve (54) and the second three-way valve (55) switch between a first state shown in FIG. 7 and a second state shown in FIG. 8. In the first state, each of the three-way valves (54, 55) makes the first port (1) communicate with the second port (2), and closes the third port (3). In the second state, each of the three-way valves (54, 55) makes the first port (1) communicate with the third port (3), and closes the second port (2).

The bypass channel (56) is connected to the third port (3) of the first three-way valve (54) and the third port (3) of the second three-way valve (55).

—Operation—

The hot water supply apparatus (10) of the second embodiment performs a heating operation and a cooling operation. The heating operation of the second embodiment is the same as the heating operation of the first embodiment. The cooling operation of the second embodiment includes a normal action and a bypass action.

<Heating Operation>

In the heating operation, the heat source device (20) performs the first refrigeration cycle. The controller (80) operates the water pump (53). The controller (80) sets the first three-way valve (54) and the second three-way valve (55) to the first state. Water in the low-temperature portion (L) of the tank (40) is heated by the utilization heat exchanger (25), and then returns to the high-temperature portion (H) of the tank (40).

<Normal Action of Cooling Operation>

In the normal action of the cooling operation shown in FIG. 7, the heat source device (20) performs the second refrigeration cycle. The controller (80) operates the water pump (53). The controller (80) sets the first three-way valve (54) and the second three-way valve (55) to the first state. The water in the low-temperature portion (L) of the tank (40) is cooled by the utilization heat exchanger (25), and then returns to the high-temperature portion (H) of the tank (40).

In the normal action of the cooling operation, the heat source device (20) cools the water in the first channel (25*a*). The low-temperature water in the tank (40) is supplied to the first channel (25*a*). Thus, the temperature of the water in the first channel (25*a*) can be quickly lowered, removing the scale.

<Bypass Action of Cooling Operation>

In the bypass action of the cooling operation shown in FIG. 8, the heat source device (20) performs the second refrigeration cycle. The controller (80) operates the water pump (53). The controller (80) sets the first three-way valve (54) and the second three-way valve (55) to the second state. In the bypass action, a circulation channel including the utilization heat exchanger (25) and the water pump (53) is formed. This circulation channel is separated from the tank (40). Water conveyed by the water pump (53) is cooled in the first channel (25*a*) of the utilization heat exchanger (25), and then flows through the bypass channel (56). The water flowing through the bypass channel (56) is sent again to the first channel (25*a*) of the utilization heat exchanger (25).

In the bypass action of the cooling operation, the water cooled by the utilization heat exchanger (25) bypasses the tank (40). Specifically, the water cooled by the utilization heat exchanger (25) does not return to the tank (40). This can keep the amount of heat stored in the tank (40) from decreasing due to the return of the low-temperature water to the tank (40). Strictly speaking, this can block a significant decrease in the amount of heat stored in the tank (40) due to the return of the low-temperature water to the high-temperature portion (H) of the tank (40).

—Switching Between Actions—

The cooling operation is performed when a predetermined first condition is met in the heating operation. The predetermined first condition is an establishment condition for the first determination described above. When the first condition is met, the controller (80) performs the normal action of the cooling operation.

The temperature of the water in the water circuit (50) needs to be lowered quickly immediately after the end of the heating operation. In the normal action described above, the water in the first channel (25*a*) is cooled by the heat source device (20), and the low-temperature water in the low-temperature portion (L) of the tank (40) is supplied to the water circuit (50). This can quickly lower the temperature of the water in the water circuit (50), removing the scale quickly. In the normal action, relatively hot water in the water circuit (50) returns to the high-temperature portion (H) of the tank (40). Thus, the amount of heat stored in the tank (40) does not greatly decrease.

When a predetermined second condition is met after the normal action starts, the bypass action is performed. The second condition includes condition a) and condition b). The condition a) is that the temperature Tw of the water detected by the temperature sensor (61) falls below a predetermined temperature. The condition b) is that predetermined time has elapsed since the normal action started. The temperature of the water in the water circuit (50) is relatively low at the start of the bypass action. Thus, the low-temperature water in the water circuit (50) can be reliably kept from returning to the high-temperature portion (H) of the tank (40). Cooling the water in the water circuit (50) in the first channel (25*a*) without passing through the tank (40) can quickly lower the temperature of the first channel (25*a*). Thus, the scale in the water circuit (50) can be removed in a short time.

Advantages of Second Embodiment

As a first feature of the second embodiment, the water circuit (50) includes the bypass section (B) that forms a channel through which the water cooled in the first channel (25*a*) of the heat exchanger (25) bypasses the tank (40) and returns to the first channel (25*a*) in the second operation.

According to the first feature of the second embodiment, the bypass section (B) allows the bypass action to be performed. This can reliably keep the high-temperature water in the water circuit (50) from returning to the tank (40), and can quickly reduce the temperature of the water in the water circuit (50).

In the cooling operation of the second embodiment, the controller (80) may perform only the bypass action without performing the normal action.

Third Embodiment

Figure 9:
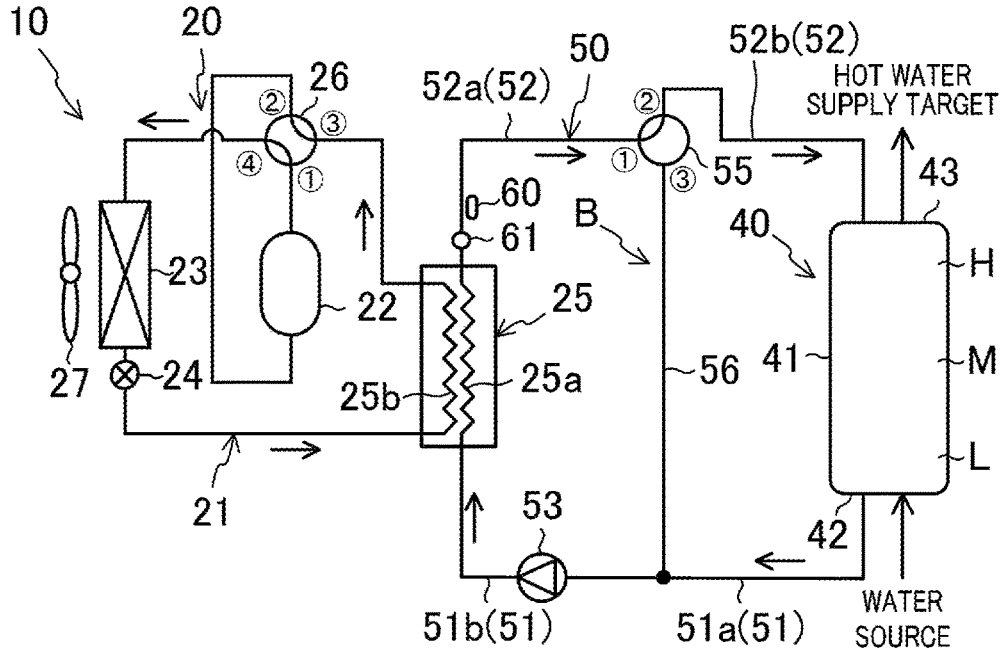
FIG. 9 is a schematic piping system diagram of a hot water supply apparatus according to a third embodiment performing the normal action of the cooling operation.
Figure 10:
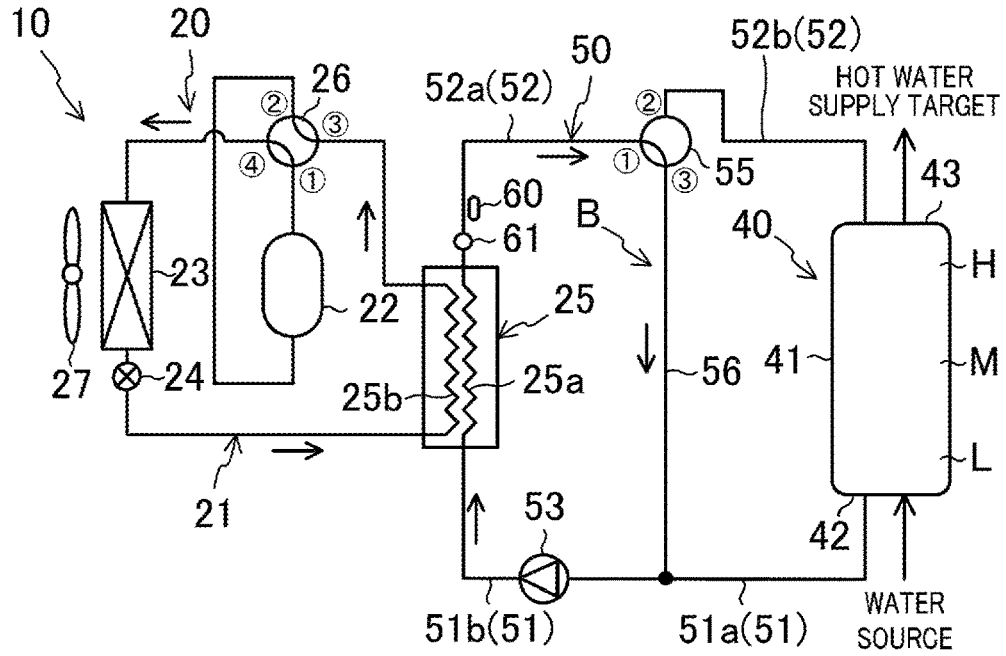
FIG. 10 is a schematic piping system diagram of the hot water supply apparatus according to the third embodiment performing the bypass action of the cooling operation.

As illustrated in FIGS. 9 and 10, a hot water supply apparatus (10) of a third embodiment is a modified version of the hot water supply apparatus of the second embodiment in which the water circuit (50) has no first three-way valve (54). An outflow end of the bypass channel (56) is directly connected to the upstream channel (51).

In the heating operation, the heat source device (20) performs the first refrigeration cycle. The controller (80) operates the water pump (53). The controller (80) sets the second three-way valve (55) to the second state. Water in the low-temperature portion (L) of the tank (40) is heated by the utilization heat exchanger (25), and then returns to the high-temperature portion (H) of the tank (40).

<Normal Action of Cooling Operation>

In the normal action of the cooling operation shown in FIG. 9, the heat source device (20) performs the second refrigeration cycle. The controller (80) operates the water pump (53). The controller (80) sets the second three-way valve (55) to the first state. The water in the low-temperature portion (L) of the tank (40) is cooled by the utilization heat exchanger (25), and then returns to the high-temperature portion (H) of the tank (40).

<Bypass Action of Cooling Operation>

In the bypass action of the cooling operation shown in FIG. 10, the heat source device (20) performs the second refrigeration cycle. The controller (80) operates the water pump (53). The controller (80) sets the second three-way valve (55) to the second state. In the bypass action, a circulation channel including the utilization heat exchanger (25) and the water pump (53) is formed. This circulation channel is separated from the tank (40). Water conveyed by the water pump (53) is cooled in the first channel (25*a*) of the utilization heat exchanger (25), and then flows through the bypass channel (56). The water flowing through the bypass channel (56) is sent again to the first channel (25*a*) of the utilization heat exchanger (25).

The hot water supply apparatus of the third embodiment can have fewer three-way valves than the apparatus of the second embodiment. Other advantages are the same as, or similar to, those of the second embodiment.

Fourth Embodiment

Figure 11:
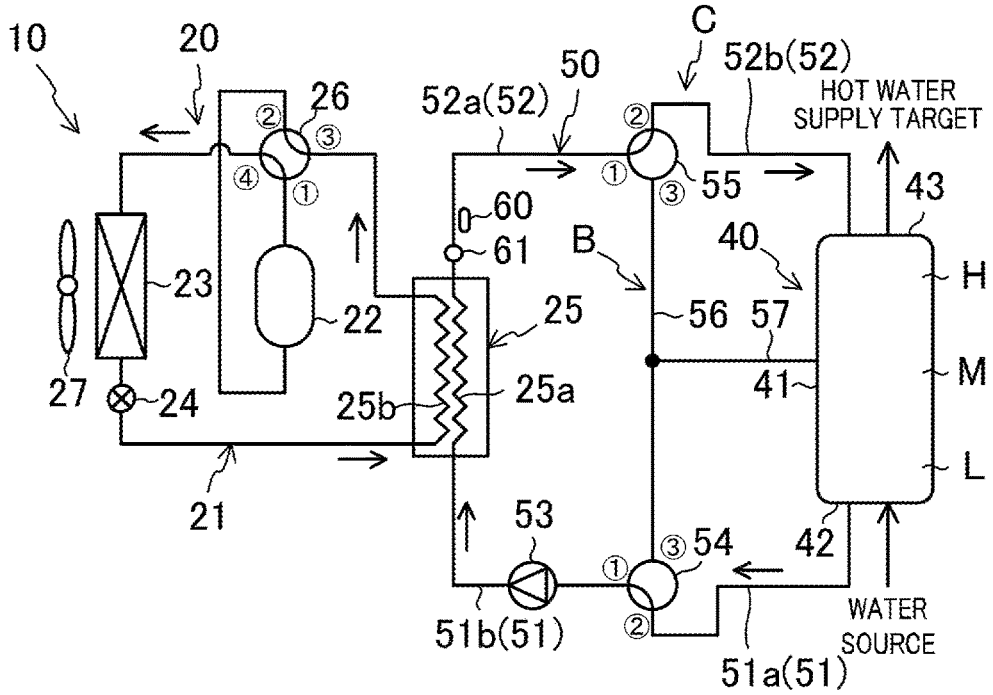
FIG. 11 is a schematic piping system diagram of a hot water supply apparatus according to a fourth embodiment performing the normal action of the cooling operation.
Figure 12:
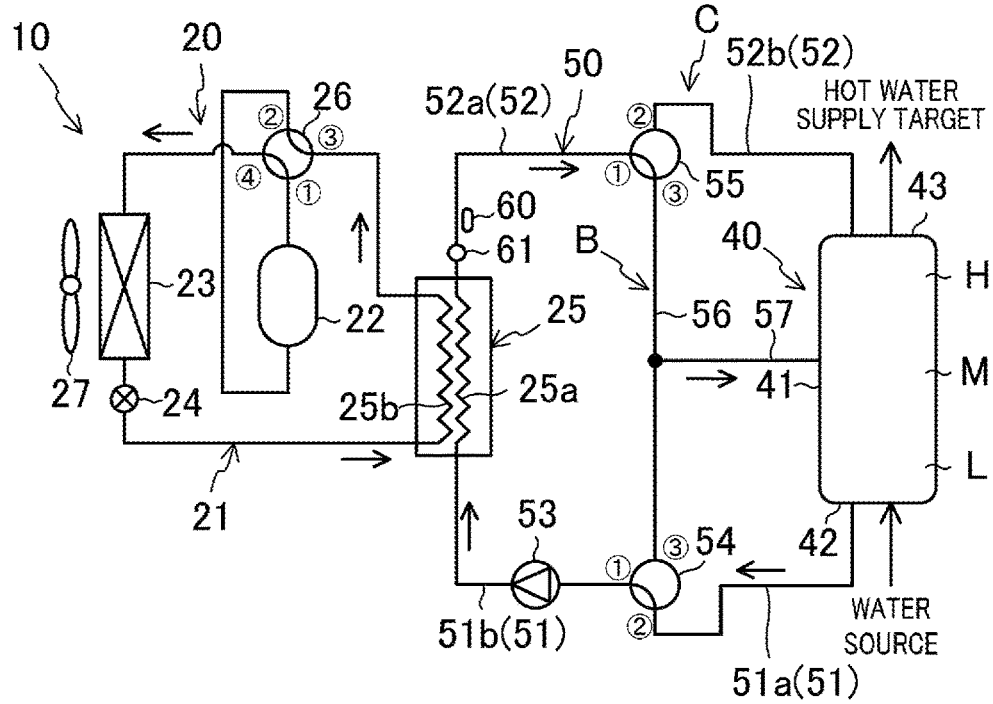
FIG. 12 is a schematic piping system diagram of the hot water supply apparatus according to the fourth embodiment performing a medium-temperature water returning action of the cooling operation.
Figure 13:
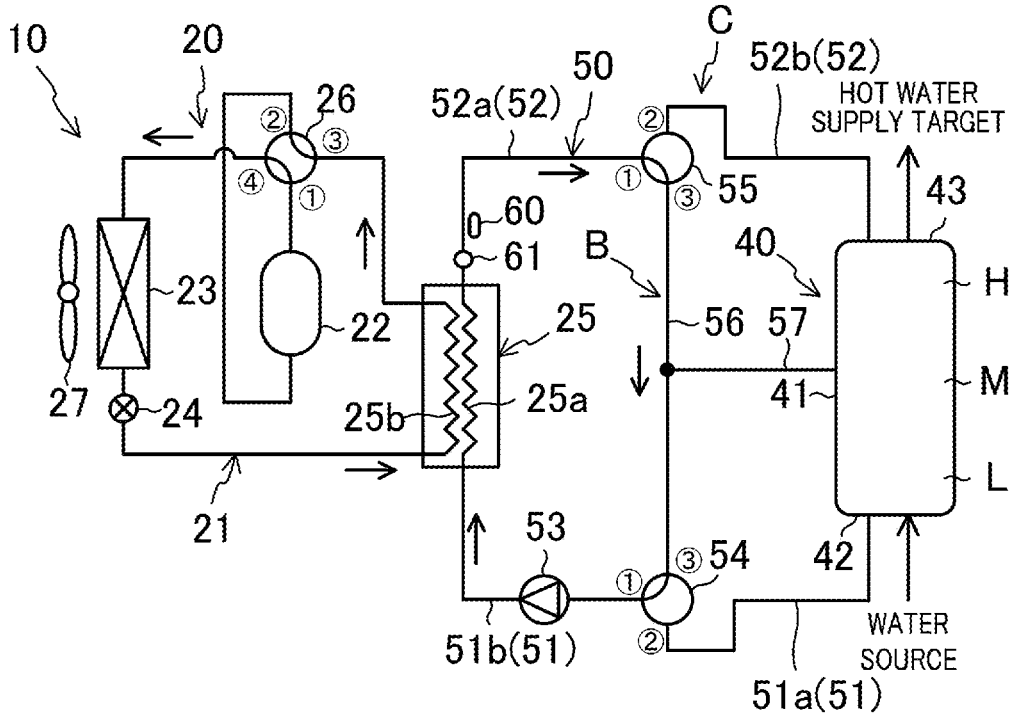
FIG. 13 is a schematic piping system diagram of the hot water supply apparatus according to the fourth embodiment performing the bypass action of the cooling operation.

As illustrated in FIGS. 11 to 13, a water circuit (50) of a hot water supply apparatus (10) of a fourth embodiment is formed by adding a medium-temperature water returning channel (57) to the water circuit (50) of the second embodiment. An inflow end of the medium-temperature water returning channel (57) is connected to the bypass channel (56). An outflow end of the medium-temperature water returning channel (57) communicates with the low-temperature portion (L) of the tank (40).

In the same manner as in the second embodiment, the first three-way valve (54), the second three-way valve (55), and the bypass channel (56) constitute the bypass section (B).

In the fourth embodiment, the first three-way valve (54), the second downstream channel (52*b*), and the medium-temperature water returning channel (57) constitute a channel changing section (C). The second downstream channel (52*b*) corresponds to a high-temperature water returning channel. In the cooling operation, the channel changing section (C) returns the water cooled in the first channel (25*a*) of the utilization heat exchanger (25) to a portion of the tank (40) having a different water temperature according to the temperature of the water in the water circuit (50). The channel changing section (C) returns the water cooled in the first channel (25*a*) of the utilization heat exchanger (25) to the high-temperature portion (H) or medium-temperature portion (M) of the tank (40) according to the temperature Tw detected by the temperature sensor (61). In the fourth embodiment, the high-temperature portion (H) corresponds to a first portion of the tank (40). The medium-temperature portion (M) of the tank (40) corresponds to a second portion having a lower temperature than the first portion.

More specifically, the controller (80) performs the normal action when the temperature Tw of the water in the water circuit (50) is higher than a first value. When the temperature Tw of the water in the water circuit (50) is lower than a second value, the controller (80) performs a medium-temperature water returning action. Strictly speaking, the controller (80) performs the medium-temperature water returning action when the temperature Tw of the water in the water circuit (50) is lower than the second value and higher than a third value. When the temperature of the water in the water circuit (50) is lower than the third value, the controller (80) performs the bypass action. The second value is equal to or less than the first value. In this example, the controller (80) sets the first value and the second value as the same value (first determination value Ts1). The third value is lower than the second value. The controller (80) sets the third value as a second determination value Ts2.

—Operation—

The hot water supply apparatus (10) of the fourth embodiment performs the heating operation and the cooling operation. The heating operation of the fourth embodiment is the same as the heating operation of the second embodiment, and will not be described below. The cooling operation of the fourth embodiment includes a normal action, a medium-temperature water returning action, and a bypass action.

<Normal Action of Cooling Operation>

In the normal action of the cooling operation shown in FIG. 11, the heat source device (20) performs the second refrigeration cycle. The controller (80) operates the water pump (53). The controller (80) sets the first three-way valve (54) and the second three-way valve (55) to the first state. The water in the low-temperature portion (L) of the tank (40) is cooled by the utilization heat exchanger (25), and then returns to the high-temperature portion (H) of the tank (40).

In the normal action of the cooling operation, the heat source device (20) cools the water in the first channel (25*a*). The low-temperature water in the tank (40) is supplied to the first channel (25*a*). Thus, the temperature of the water in the first channel (25*a*) can be quickly lowered, removing the scale.

<Medium-Temperature Water Returning Action of Cooling Operation>

In the medium-temperature water returning action of the cooling operation shown in FIG. 12, the heat source device (20) performs the second refrigeration cycle. The controller (80) operates the water pump (53). The controller (80) sets the first three-way valve (54) to the first state and the second three-way valve (55) to the second state. The water in the low-temperature portion (L) of the tank (40) is cooled by the utilization heat exchanger (25). The water cooled by the utilization heat exchanger (25) passes through an upstream portion of the bypass channel (56) and the medium-temperature water returning channel (57), and is sent to the low-temperature portion (L) of the tank (40).

<Bypass Action of Cooling Operation>

In the bypass action of the cooling operation shown in FIG. 13, the heat source device (20) performs the second refrigeration cycle. The controller (80) operates the water pump (53). The controller (80) sets the first three-way valve (54) and the second three-way valve (55) to the second state. In the bypass action, a circulation channel including the utilization heat exchanger (25) and the water pump (53) is formed. This circulation channel is separated from the tank (40). Water conveyed by the water pump (53) is cooled in the first channel (25*a*) of the utilization heat exchanger (25), and then flows through the bypass channel (56). The water flowing through the bypass channel (56) is sent again to the first channel (25*a*) of the utilization heat exchanger (25).

—Switching Between Actions—

The controller (80) performs the cooling operation when a predetermined first condition is met in the heating operation. In the cooling operation, the actions described above are switched according to the temperature Tw.

When the temperature Tw of the water in the water circuit (50) is higher than a first threshold value Ts1, the controller (80) performs the normal action. In the normal action, the high-temperature water in the water circuit (50) returns to the high-temperature portion (H) of the tank (40). This can keep the amount of heat stored in the tank (40) from greatly decreasing.

When the temperature Tw of the water in the water circuit (50) is lower than the first threshold value Ts1 and higher than a second threshold value Ts2, the controller (80) performs the medium-temperature water returning action. In the medium-temperature water returning action, the medium-temperature water in the water circuit (50) returns to the medium-temperature portion (M) of the tank (40). This can keep the temperature of the water in the high-temperature portion (H) of the tank (40) from decreasing due to the return of the water in the water circuit (50) to the tank (40).

When the temperature Tw of the water in the water circuit (50) is lower than the second threshold value Ts2, the controller (80) performs the bypass action. In the bypass action, the low-temperature water in the water circuit (50) does not return to the tank (40). This can keep the amount of heat stored in the tank (40) from greatly decreasing. Cooling the water in the water circuit (50) in the first channel (25*a*) without passing through the tank (40) can quickly lower the temperature of the first channel (25*a*). Thus, the scale in the water circuit (50) can be removed in a short time.

Three or more return pipes may be connected to the tank (40). In this case, the channel changing section (C) sends the water to one of the pipes having the smallest difference between the temperature of the returning water and the temperature of the water in the tank, which is the destination of the returning water, according to the temperature of the water in the water circuit (50).

The controller (80) may perform the bypass action when predetermined time has elapsed after the start of the cooling operation.

Advantages of Fourth Embodiment

As a first feature of the fourth embodiment, the water circuit (50) includes the channel changing section (C) configured to return the water cooled in the first channel (25*a*) of the heat exchanger (25) to a portion of the tank (40) having a different water temperature according to the temperature of the water in the water circuit (50) in the second operation.

According to the first feature of the fourth embodiment, it is possible to keep, in the cooling operation, the temperature of the water in the tank (40) from decreasing or the amount of heat stored in the tank (40) from decreasing, due to the return of the water in the water circuit (50) to the tank (40).

As a second feature of the fourth embodiment, the channel changing section (C) returns the water cooled in the first channel (25*a*) of the heat exchanger (25) to the first portion of the tank (40) when the temperature of the water in the water circuit (50) is higher than the first value in the second operation, and returns the water cooled in the first channel (25*a*) of the heat exchanger (25) to the second portion of the tank (40) having a lower temperature than the first portion when the temperature of the water in the water circuit (50) is lower than the second value equal to or less than the first value in the second operation.

According to the second feature of the fourth embodiment, when the temperature of the water in the water circuit (50) is high, the water can return to the high-temperature portion (H) which is the first portion of the tank (40). When the water in the water circuit (50) has a medium temperature, the water can return to the medium-temperature portion (M) which is the second portion of the tank (40). It is thus possible to reliably keep the temperature of the water in the tank (40) from decreasing or the amount of heat stored in the tank (40) from decreasing.

Fifth Embodiment

Figure 14:
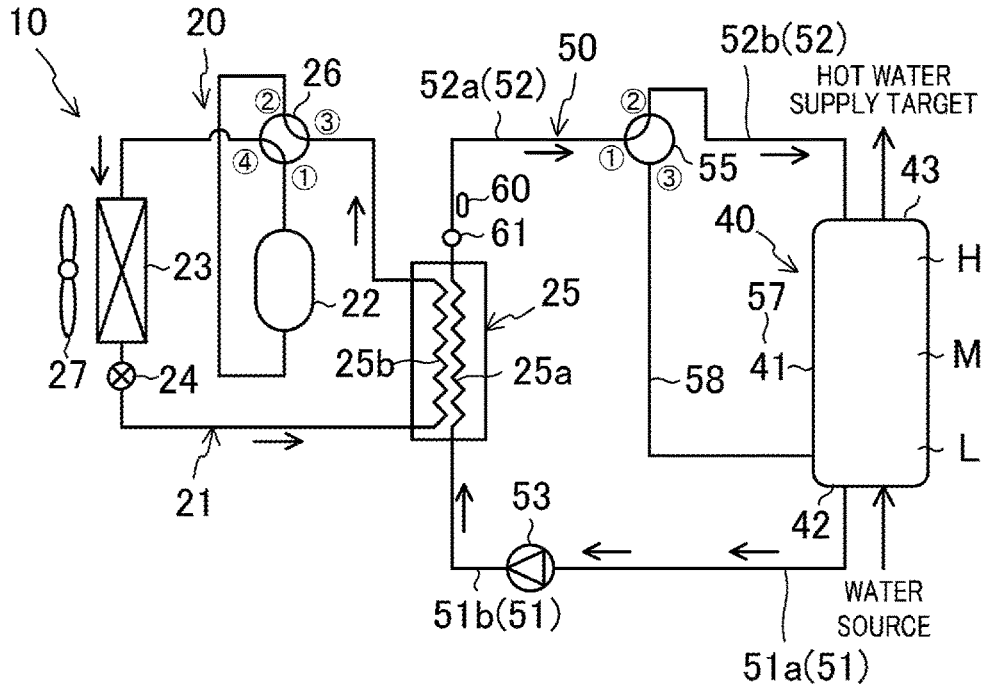
FIG. 14 is a schematic piping system diagram of a hot water supply apparatus according to a fifth embodiment performing the normal action of the cooling operation.
Figure 15:
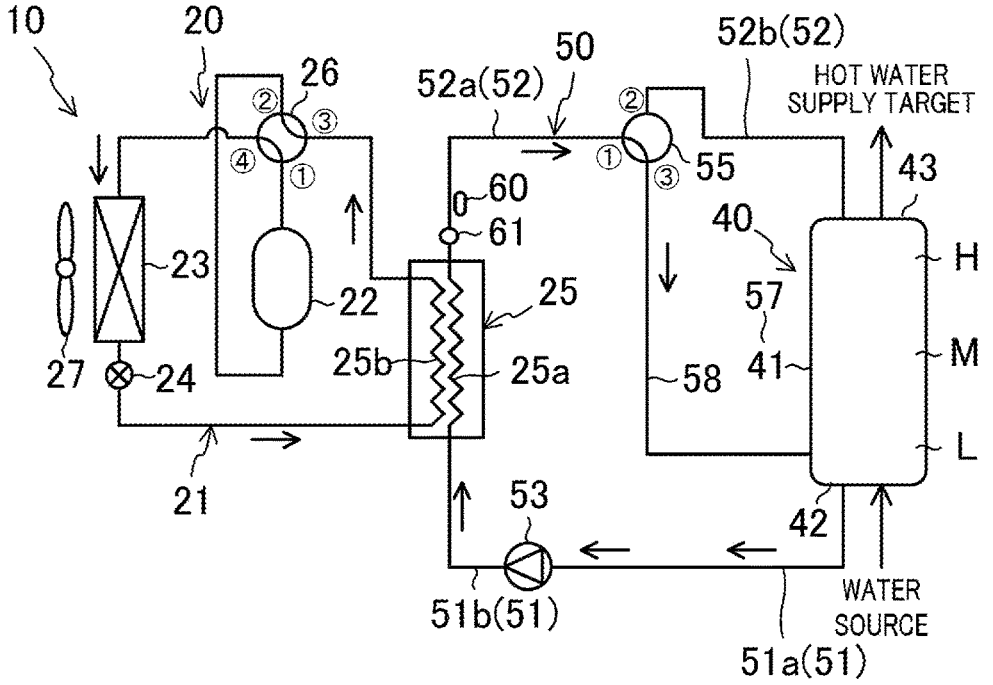
FIG. 15 is a schematic piping system diagram of the hot water supply apparatus according to the fifth embodiment performing a low-temperature water returning action of the cooling operation.

As illustrated in FIGS. 14 and 15, a water circuit (50) of a fifth embodiment is formed by removing the first three-way valve (54) from the water circuit of the second embodiment. The water circuit (50) of the fifth embodiment has a low-temperature water returning channel (58) in place of the bypass channel (56). An inflow end of the low-temperature water returning channel (58) is connected to the third port (3) of the second three-way valve (55). An outflow end of the low-temperature water returning channel (58) is connected to the low-temperature portion (L) of the tank (40).

In the fifth embodiment, the second three-way valve (55), the second downstream channel (52*b*), and the low-temperature water returning channel (58) constitute a channel changing section (C). The second downstream channel (52*b*) corresponds to a high-temperature water returning channel. In the cooling operation, the channel changing section (C) returns the water cooled in the first channel (25*a*) of the utilization heat exchanger (25) to a portion of the tank (40) having a different water temperature according to the temperature of the water in the water circuit (50). The channel changing section (C) returns the water cooled in the first channel (25*a*) of the utilization heat exchanger (25) to the high-temperature portion (H) or low-temperature portion (L) of the tank (40) according to the temperature Tw detected by the temperature sensor (61). In the fifth embodiment, the high-temperature portion (H) corresponds to the first portion of the tank (40). The low-temperature portion (L) corresponds to the second portion of the tank (40) having a lower temperature than the first portion.

More specifically, the controller (80) performs the normal action when the temperature Tw of the water in the water circuit (50) is higher than a first value. When the temperature Tw of the water in the water circuit (50) is lower than a second value, the controller (80) performs a low-temperature water returning action. The second value is equal to or less than the first value. In this example, the controller (80) sets the first value and the second value as the same value (third determination value Ts3).

—Operation—

The hot water supply apparatus (10) of the fifth embodiment performs the heating operation and the cooling operation. The heating operation of the fifth embodiment is the same as the heating operation of the second embodiment, and will not be described below. The cooling operation of the fifth embodiment includes a normal action and a low-temperature water returning action.

<Normal Action of Cooling Operation>

In the normal action of the cooling operation shown in FIG. 14, the heat source device (20) performs the second refrigeration cycle. The controller (80) operates the water pump (53). The controller (80) sets the second three-way valve (55) to the first state. The water in the low-temperature portion (L) of the tank (40) is cooled by the utilization heat exchanger (25), and then returns to the high-temperature portion (H) of the tank (40).

<Medium-Temperature Water Returning Action of Cooling Operation>

In the medium-temperature water returning action of the cooling operation shown in FIG. 15, the heat source device (20) performs the second refrigeration cycle. The controller (80) operates the water pump (53). The controller (80) sets the second three-way valve (55) to the second state. The water in the low-temperature portion (L) of the tank (40) is cooled by the utilization heat exchanger (25). The water cooled by the utilization heat exchanger (25) passes through the low-temperature water returning channel (58), and is sent to the low-temperature portion (L) of the tank (40).

—Switching Between Actions—

The controller (80) performs the cooling operation when a predetermined first condition is met in the heating operation.

In the cooling operation, the actions described above are switched according to the temperature Tw.

When the temperature Tw of the water in the water circuit (50) is higher than a third threshold value Ts3, the controller (80) performs the normal action. In the normal action, the high-temperature water in the water circuit (50) returns to the high-temperature portion (H) of the tank (40). This can keep the amount of heat stored in the tank (40) from greatly decreasing.

When the temperature Tw of the water in the water circuit (50) is lower than the third threshold value Ts3, the low-temperature water returning action is performed. In the low-temperature water returning action, the low-temperature water in the water circuit (50) returns to the low-temperature portion (L)) of the tank (40). This can keep the temperature of the water in the tank (40) from decreasing due to the return of the water in the water circuit (50) to the tank (40).

Variations of Embodiment

All the embodiments described above may be modified as described in the following variations within an applicable range. The variations described below can be appropriately combined or substituted within an applicable range.

—Variation A (First Determination)—A determination of whether to perform the cooling operation in the heating operation may be made as described in the following variations.

<Variation A-1>

The controller (80) may determine in the first determination whether to perform the cooling operation, based on the integrated value of only the operation time ΔT1 of the heating operation. When the integrated value of the operation time ΔT1 of the heating operation increases, it can be estimated that the amount of scale in the water circuit (50) increases. When the integrated value of the operation time ΔT1 of the heating operation exceeds a predetermined value in the heating operation, the controller (80) performs the cooling operation. This allows the hot water supply apparatus (10) to determine whether to perform the cooling operation without using a sensor or any other devices.

<Variation A-2>

The controller (80) may perform the cooling operation when it is determined in the first determination that an integrated value which is based on the operation time ΔT1 of the heating operation and the temperature Tw of the water in the water circuit (50) exceeds a predetermined value.

<Variation A-3>

The controller (80) may perform the cooling operation when it is determined in the first determination that an integrated value which is based on the operation time ΔT1 of the heating operation and the pressure Pw of the water in the water circuit (50) exceeds a predetermined value.

—Variations of Second Determination—

A determination of whether to end the cooling operation in the cooling operation may be performed as described in the following variations.

<Variation A-4>

Figure 16:
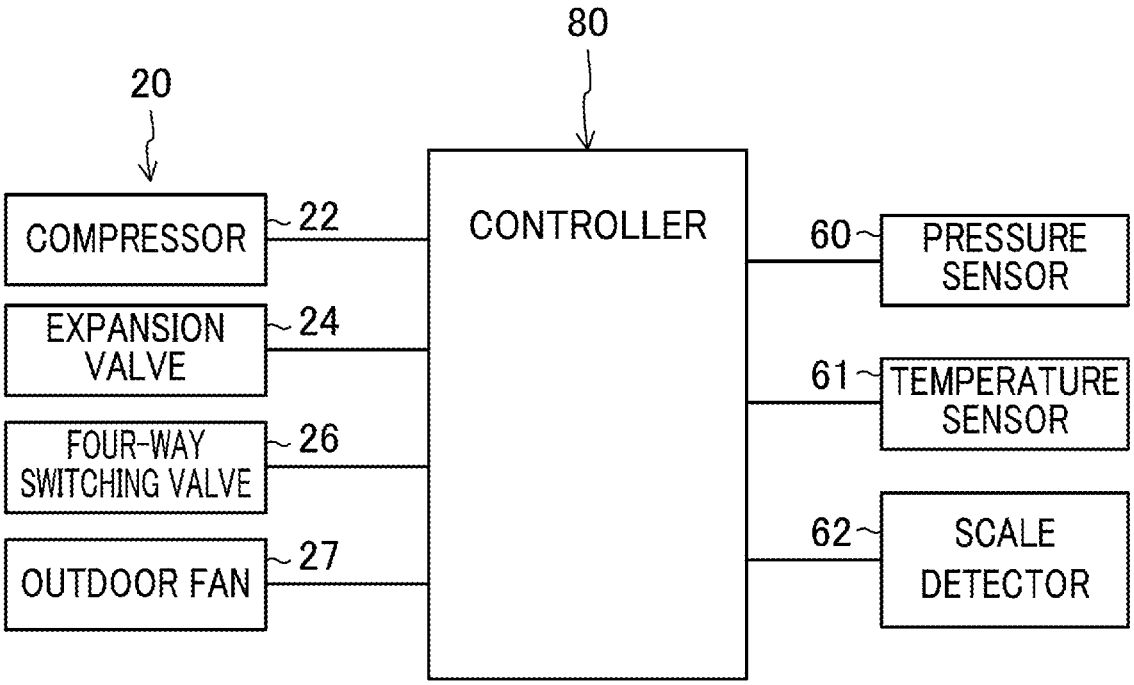
FIG. 16 is a block diagram illustrating relationship between a controller according to Variation A-4 and its peripheral devices.

As illustrated in FIG. 16, the hot water supply apparatus (10) may include a scale detector (62) that detects an index indicating the amount of scale in the water circuit (50). The scale detector (62) detects, for example, the efficiency a of the utilization heat exchanger (25), the flow rate Q of the water circulating in the water circuit (50), and the ion concentration C of the water in the water circuit (50), as detection values.

When the amount of scale in the water circuit (50) increases and the scale adheres to the inner wall of the first channel (25*a*) of the utilization heat exchanger (25), the efficiency of the utilization heat exchanger (25) decreases. When the amount of scale in the water circuit (50) increases and the channel of the water circuit (50) is narrowed, the flow rate of the water in the water circuit (50) decreases. When the amount of scale in the water circuit (50) increases, the concentration of ions such as calcium in the water circuit (50) decreases. Thus, it can be estimated that the amount of scale is increasing based on these indexes detected by the scale detector (62).

The controller (80) determines in the first determination whether to perform the cooling operation based on the detection values detected by the scale detector (62).

Specifically, the controller (80) performs the cooling operation when the amount of decrease in the efficiency a detected by the scale detector (62) exceeds a predetermined value. Alternatively, the controller (80) performs the cooling operation when the amount of decrease in the flow rate Q detected by the scale detector (62) exceeds a predetermined value. Alternatively, the controller (80) performs the cooling operation when the amount of decrease in the ion concentration detected by the scale detector (62) exceeds a predetermined value. In this way, the increase in the scale amount can be determined more accurately using the amount of change in the index indicating the scale amount.

The controller (80) may determine whether to perform the cooling operation based on the absolute value of the index detected by the scale detector (62).

—Variation B (Second Determination)—

A determination of whether to end the cooling operation in the cooling operation may be performed as described in the following variations.

<Variation B-1>

The controller (80) may determine in the second determination whether to end the cooling operation based on only the operation time ΔT2 of the cooling operation. When the operation time ΔT2 of the cooling operation increases, it can be estimated that the amount of scale in the water circuit (50) decreases. When the operation time ΔT2 of the cooling operation exceeds a predetermined value in the cooling operation, the controller (80) ends the cooling operation. This allows the hot water supply apparatus (10) to determine whether to end the cooling operation without using a sensor or any other devices.

<Variation B-2>

The controller (80) may end the cooling operation when it is determined in the second determination that an estimated value which is based on the operation time ΔT2 of the cooling operation and the temperature Tw of the water in the water circuit (50) falls below a predetermined value.

<Variation B-3>

The controller (80) may perform the cooling operation when it is determined in the second determination that an estimated value which is based on the operation time ΔT2 of the cooling operation and the pressure Pw of the water in the water circuit (50) falls below a predetermined value.

<Variation B-4>

The controller (80) may determine in the second determination whether to end the cooling operation based on an index indicating the amount of scale detected by the scale detector (62), in the same manner as in Variation A-4.

Specifically, the controller (80) ends the cooling operation when the amount of increase in the efficiency a detected by the scale detector (62) exceeds a predetermined value. Alternatively, the controller (80) ends the cooling operation when the amount of increase in the flow rate Q detected by the scale detector (62) exceeds a predetermined value. Alternatively, the controller (80) ends the cooling operation when the amount of increase in the ion concentration detected by the scale detector (62) exceeds a predetermined value. In this way, the decrease in the scale amount can be determined more accurately using the amount of change in the index indicating the scale amount.

The controller (80) may determine whether to end the cooling operation based on the absolute value of the index detected by the scale detector (62).

<Variation B-5>

The controller (80) may determine in the second determination whether to end the cooling operation based on the temperature Tw of the water in the water circuit (50). When the cooling operation is performed, the temperature of the water in the water circuit (50) decreases, and the scale dissolves in the water. Thus, it can be estimated, based on the temperature Tw, that the amount of scale in the water circuit (50) has decreased. The controller (80) ends the cooling operation when the temperature Tw of the water in the water circuit (50) falls below a predetermined value in the cooling operation. This predetermined value is preferably the same as the precipitation temperature of the scale.

—Variation C (Pump Stop Action)—

Figure 17:
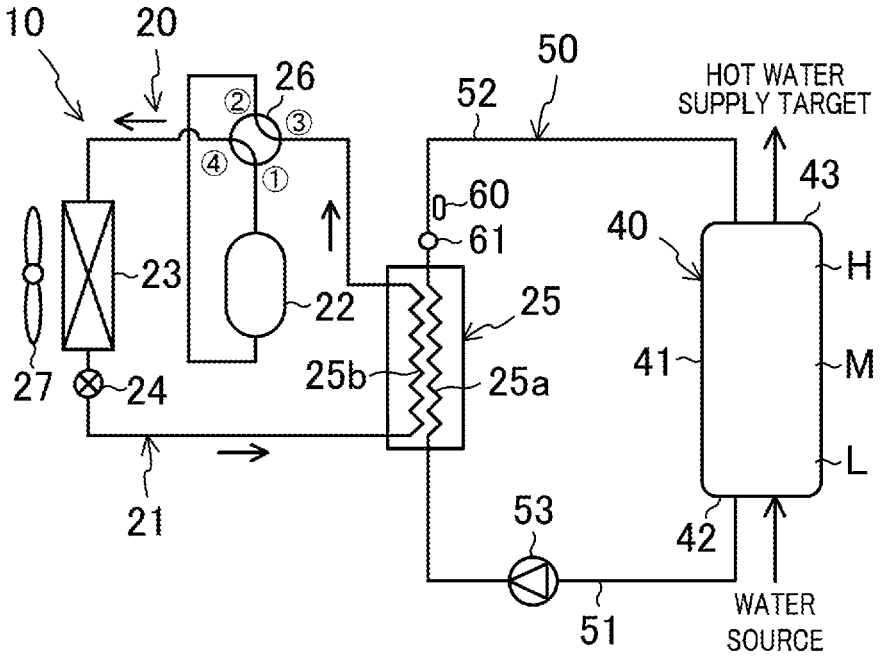
FIG. 17 is a schematic piping system diagram of a hot water supply apparatus according to Variation C performing a pump stop action of the cooling operation.

In all the embodiments described above, the controller (80) operates a circulation pump (71) in the cooling operation. The cooling operation may include a pump stop action illustrated in FIG. 17.

In the pump stop action, the controller (80) controls the heat source device (20) so that the heat source device (20) performs the second refrigeration cycle. The controller (80) stops the circulation pump (71).

In the utilization heat exchanger (25), the water remains in the first channel (25*a*), and a low-pressure refrigerant flows through the second channel (25*b*). Thus, in the utilization heat exchanger (25), the refrigerant in the second channel (25*b*) absorbs heat from the water in the first channel (25*a*) and evaporates. The water in the first channel (25*a*), which does not move, suddenly drops in temperature. This can reliably remove the scale from the first channel (25*a*).

—Advantages of Variation C—

As a first feature of Variation C, the water circuit (50) has a first pump (53) that circulates the water, and the controller (80) stops the first pump (53) in the second operation.

According to the first feature of Variation C, the temperature of the water in the first channel (25*a*) can be quickly lowered. Thus, time for removing the scale from the first channel (25*a*) can be greatly shortened.

According to the first feature of Variation C, the temperature of the utilization heat exchanger (25) can be quickly lowered. Thus, the scale can be peeled off the inner wall of the first channel (25*a*) using the thermal contraction of the utilization heat exchanger (25).

—Variation D (Heating Medium Circuit)—

The hot water supply apparatus (10) of each of the embodiments described above may include a heating medium circuit (70) having a primary heat exchanger (28) and a utilization heat exchanger (25).

Figure 18:
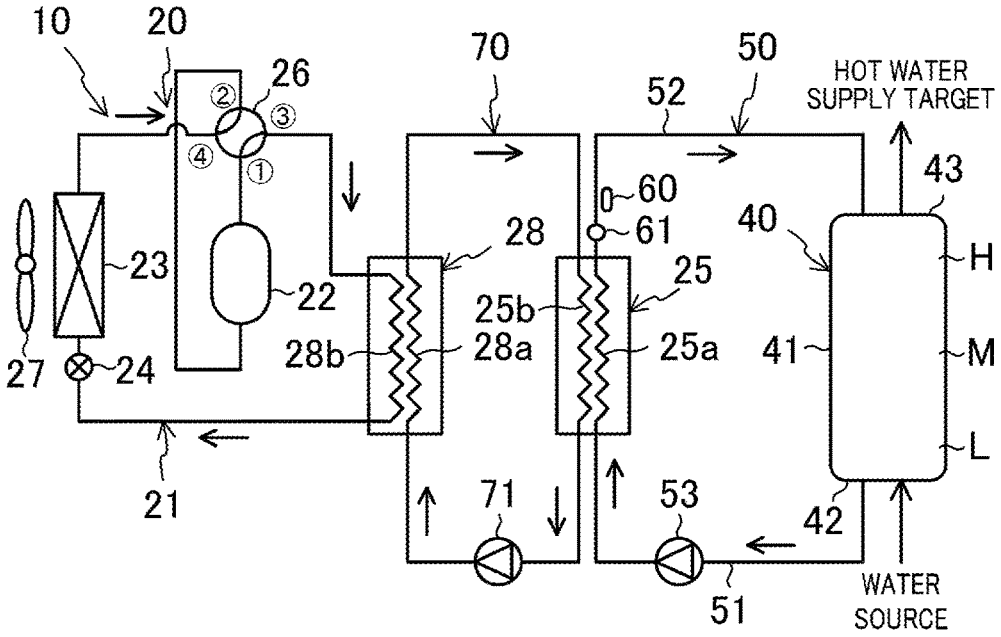
FIG. 18 is a schematic piping system diagram of a hot water supply apparatus according to Variation D performing the heating operation.
Figure 19:
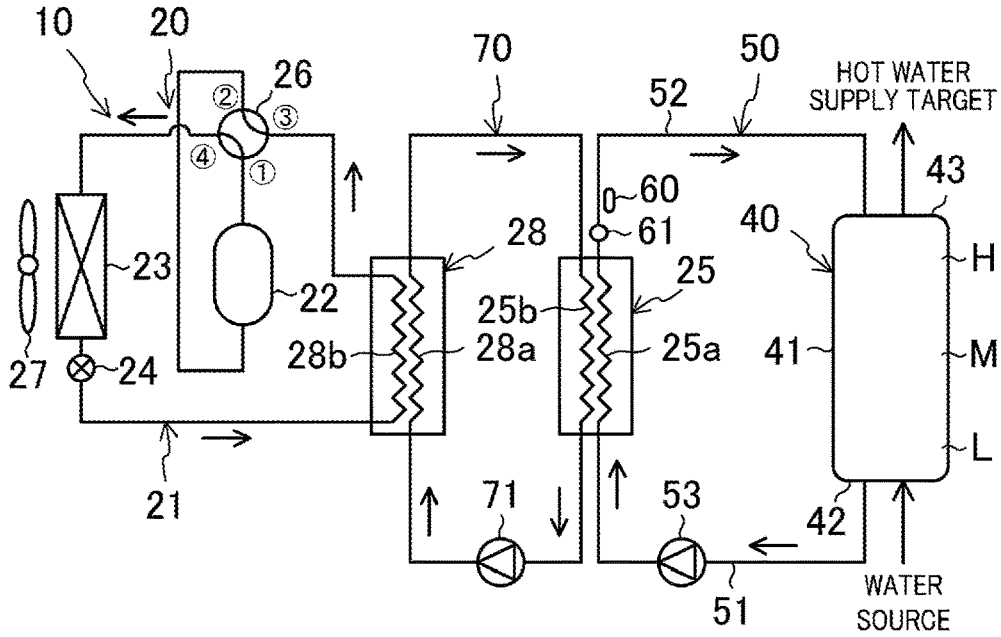
FIG. 19 is a schematic piping system diagram of the hot water supply apparatus according to Variation D performing the cooling operation.

As illustrated in FIGS. 18 and 19, the primary heat exchanger (28) is connected to the refrigerant circuit (21) of the heat source device (20) in place of the utilization heat exchanger (25) of the above-described embodiments. The primary heat exchanger (28) has a third channel (28*a*) and a fourth channel (28*b*). The third channel (28*a*) is connected to the heating medium circuit (70). The fourth channel (28*b*) is connected to the refrigerant circuit (21). The first channel (25*a*) of the utilization heat exchanger (25) is connected to the water circuit (50) in the same manner as in the above-described embodiments. The second channel (25*b*) of the utilization heat exchanger (25) is connected to the heating medium circuit (70).

The heating medium circuit (70) is a closed circuit in which a heating medium circulates. The heating medium is composed of, for example, water, or a liquid containing brine. The heating medium circuit (70) includes a circulation pump (71). The circulation pump (71) is connected between a downstream end of the second channel (25*b*) and an upstream end of the third channel (28*a*) in the heating medium circuit (70).

<Heating Operation>

In the heating operation shown in FIG. 18, the controller (80) operates the compressor (22) and the outdoor fan (27). The controller (80) sets the four-way switching valve (26) to the first state. The controller (80) appropriately adjusts the opening degree of the expansion valve (24). The controller (80) operates the water pump (53) and the circulation pump (71).

The heat source device (20) performs the first refrigeration cycle. In the first refrigeration cycle, the refrigerant dissipates heat in the primary heat exchanger (28). More specifically, the refrigerant compressed by the compressor (22) flows through the fourth channel (28*b*) of the primary heat exchanger (28) in the first refrigeration cycle. In the primary heat exchanger (28), the refrigerant in the fourth channel (28*b*) dissipates heat to the heating medium in the third channel (28*a*). The refrigerant that has dissipated heat or condensed in the fourth channel (28*b*) is decompressed by the expansion valve (24), and then flows through the heat source heat exchanger (23). In the heat source heat exchanger (23), the refrigerant absorbs heat from the outdoor air and evaporates. The refrigerant that has evaporated in the heat source heat exchanger (23) is sucked into the compressor (22).

In the heating medium circuit (70), the heating medium discharged from the circulation pump (71) flows through the third channel (28*a*) of the primary heat exchanger (28). The heating medium in the third channel (28*a*) is heated by the refrigerant in the fourth channel (28*b*). The heating medium heated in the third channel (28*a*) flows through the second channel (25*b*) of the utilization heat exchanger (25), and is sucked into the circulation pump (71).

In the water circuit (50), the water in the low-temperature portion (L) of the tank (40) flows into the upstream channel (51). The water in the upstream channel (51) flows through the first channel (25*a*) of the utilization heat exchanger (25). The water in the first channel (25*a*) is heated by the heating medium in the heating medium circuit (70). The water heated in the first channel (25*a*) flows through the downstream channel (52) and enters the high-temperature portion (H) of the tank (40).

<Cooling Operation>

In the cooling operation shown in FIG. 19, the controller (80) operates the compressor (22) and the outdoor fan (27). The controller (80) sets the four-way switching valve (26) to the second state. The controller (80) appropriately adjusts the opening degree of the expansion valve (24). The controller (80) operates the water pump (53) and the circulation pump (71).

The heat source device (20) performs the second refrigeration cycle. In the second refrigeration cycle, the refrigerant evaporates in the primary heat exchanger (28). More specifically, the refrigerant compressed by the compressor (22) dissipates heat in the heat source heat exchanger (23) in the second refrigeration cycle. The refrigerant that has dissipated heat or condensed in the heat source heat exchanger (23) is decompressed by the expansion valve (24), and then flows through the fourth channel (28*b*) of the primary heat exchanger (28). In the primary heat exchanger (28), the refrigerant in the fourth channel (28*b*) absorbs heat from the heating medium in the third channel (28*a*). The refrigerant evaporated in the fourth channel (28*b*) is sucked into the compressor (22).

In the heating medium circuit (70), the heating medium discharged from the circulation pump (71) flows through the third channel (28*a*) of the primary heat exchanger (28). The heating medium in the third channel (28*a*) is cooled by the refrigerant in the fourth channel (28*b*). The heating medium cooled in the third channel (28*a*) flows through the second channel (25*b*) of the utilization heat exchanger (25), and is sucked into the circulation pump (71).

In the water circuit (50), the water in the low-temperature portion (L) of the tank (40) flows into the upstream channel (51). The water in the upstream channel (51) flows through the first channel (25*a*) of the utilization heat exchanger (25). The water in the first channel (25*a*) is cooled by the heating medium in the heating medium circuit (70). The water cooled in the first channel (25*a*) flows through the downstream channel (52), and enters the high-temperature portion (H) of the tank (40).

—Advantages of Variation D—

As a first feature of Variation D, the heat exchanger (25) has the second channel (25*b*) through which a heating medium that exchanges heat with the water flowing through the first channel (25*a*) flows. The hot water supply apparatus further includes the heating medium circuit (70) having the second channel (25*b*) and the second pump (71) and allowing the heating medium to circulate. The first operation is an operation in which the heat source device (20) heats the heating medium in the heating medium circuit (70) and the heated heating medium heats the water in the first channel (25*a*), and the second operation is an operation in which the heat source device (20) cools the heating medium in the heating medium circuit (70) and the cooled heating medium cools the water in the first channel (25*a*).

According to the first feature of Variation D, the heating medium circuit (70) is provided between the heat source device (20) and the water circuit (50). Thus, when the heat source device (20) and the tank (40) are located relatively away from each other, the hot water can be stored in the tank (40) without upsizing the water circuit (50) and the refrigerant circuit (21).

According to the first feature of Variation D, the heating medium circuit (70) is a closed circuit and receives no water supply. This keeps the concentration of calcium in the heating medium circuit (70) low. Thus, almost no scale is generated in the heating medium circuit (70) even if the refrigerant in the heat source device (20) heats the water in the heating medium circuit (70) to a relatively high temperature.

According to the first feature of Variation D, the temperature of the water in the first channel (25*a*) of the utilization heat exchanger (25) can be kept from excessively increasing in the heating operation. This is because the temperature of the heating medium flowing into the second channel (25*b*) of the utilization heat exchanger (25) in the heating operation is lower than the temperature of the superheated refrigerant flowing into the fourth channel (28*b*) of the primary heat exchanger (28). This can keep the scale from being generated in the first channel (25*a*) of the utilization heat exchanger (25) in the heating operation.

—Variation E (Channel Regulating Mechanism)—

The heat source device (20) of each of the embodiments described above may include a channel regulating mechanism (30).

Figure 20:
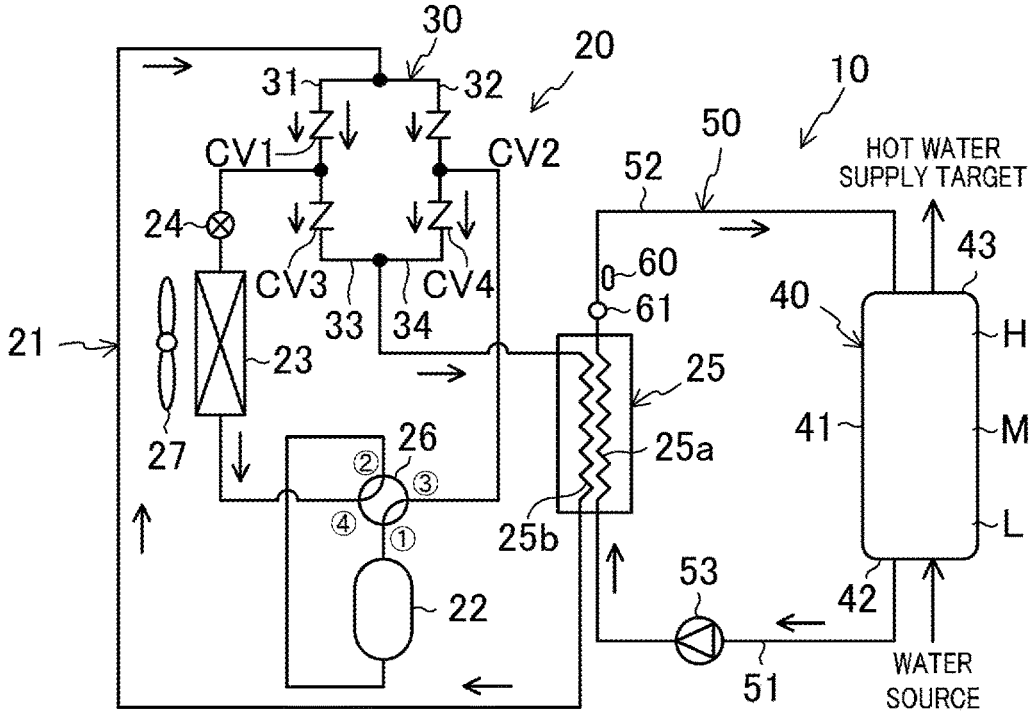
FIG. 20 is a schematic piping system diagram of a hot water supply apparatus according to Variation E performing the heating operation.

As illustrated in FIG. 20, the refrigerant circuit (21) of the heat source device (20) is provided with a channel regulating mechanism (30). The channel regulating mechanism (30) includes a first refrigerant channel (31), a second refrigerant channel (32), a third refrigerant channel (33), and a fourth refrigerant channel (34). These refrigerant channels (31, 32, 33, 34) establish bridge connection. A first check valve (CV1) is connected to the first refrigerant channel (31), a second check valve (CV2) to the second refrigerant channel (32), a third check valve (CV3) to the third refrigerant channel (33), and a fourth check valve (CV4) to the fourth refrigerant channel (34). Each of the check valves (CV1, CV2, CV3, CV4) allows the refrigerant to flow in a direction indicated by arrows shown in FIG. 20, and prohibits the refrigerant from flowing in the opposite direction.

An inflow end of the first refrigerant channel (31) and an inflow end of the second refrigerant channel (32) are connected to an outflow end of the second channel (25*b*) of the utilization heat exchanger (25). An outflow end of the first refrigerant channel (31) and an inflow end of the third refrigerant channel (33) are connected to a liquid end of the heat source heat exchanger (23) via the expansion valve (24). An outflow end of the second refrigerant channel (32) and an inflow end of the fourth refrigerant channel (34) are connected to the third port (3) of the four-way switching valve (26). An outflow end of the third refrigerant channel (33) and an outflow end of the fourth refrigerant channel (34) are connected to an inflow end of the second channel (25*b*) of the utilization heat exchanger (25).

In the refrigerant circuit (21), the four-way switching valve (26) serving as a switching mechanism switches between the first refrigeration cycle and the second refrigeration cycle. The channel regulating mechanism (30) allows the refrigerant to flow through the second channel (25*b*) in the same direction during the heating operation and the cooling operation. Thus, in the heating operation, the refrigerant in the second channel (25*b*) flows in the direction opposite to the direction in which water flows in the first channel (25*a*). In the cooling operation, the refrigerant in the second channel (25*b*) flows in the direction opposite to the direction in which water flows in the first channel (25*a*). In other words, countercurrent flow occurs in the utilization heat exchanger (25) in both of the heating operation and the cooling operation.

The utilization heat exchanger (25) may employ cocurrent flow in both of the heating operation and the cooling operation by reversing the direction of water circulation in the water circuit (50).

The channel regulating mechanism (30) may include a four-way switching valve, two three-way valves, and four on-off valves.

<Heating Operation>

In the heating operation shown in FIG. 20, the controller (80) operates the compressor (22) and the outdoor fan (27). The controller (80) sets the four-way switching valve (26) to the first state. The controller (80) appropriately adjusts the opening degree of the expansion valve (24). The controller (80) operates the water pump (53).

The heat source device (20) performs the first refrigeration cycle. In the first refrigeration cycle, the refrigerant compressed by the compressor (22) passes through the fourth refrigerant channel (34), and flows through the second channel (25*b*) of the utilization heat exchanger (25). The refrigerant in the second channel (25*b*) of the utilization heat exchanger (25) heats the water in the first channel (25*a*). The refrigerant that has dissipated heat in the second channel (25*b*) passes through the first refrigerant channel (31), and is decompressed by the expansion valve (24). The decompressed refrigerant evaporates in the heat source heat exchanger (23), and is sucked into the compressor (22).

<Cooling Operation>

Figure 21:
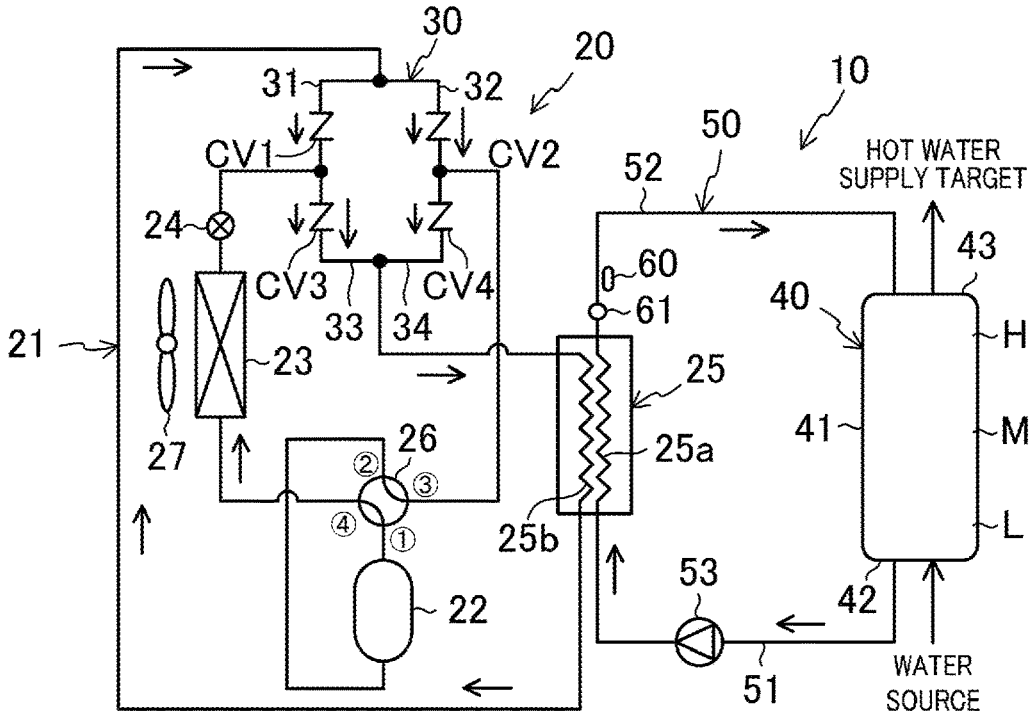
FIG. 21 is a schematic piping system diagram of the hot water supply apparatus according to Variation E performing the cooling operation.

In the cooling operation shown in FIG. 21, the controller (80) operates the compressor (22) and the outdoor fan (27). The controller (80) sets the four-way switching valve (26) to the second state. The controller (80) appropriately adjusts the opening degree of the expansion valve (24). The controller (80) operates the water pump (53).

The heat source device (20) performs the second refrigeration cycle. In the second refrigeration cycle, the refrigerant compressed by the compressor (22) dissipates heat in the heat source heat exchanger (23), and is decompressed by the expansion valve (24). The decompressed refrigerant flows through the third refrigerant channel (33), and then through the second channel (25*b*) of the utilization heat exchanger (25). In the utilization heat exchanger (25), the water in the first channel (25*a*) is cooled by the refrigerant in the second channel (25*b*). The water cooled in the first channel (25*a*) flows through the second refrigerant channel (32), and is sucked into the compressor (22).

—Advantages of Variation E—

As a first feature of Variation E, the heat source device (20) has the refrigerant circuit (21) in which the refrigerant circulates to cause the refrigeration cycle. The heat exchanger (25) has the second channel (25*b*) through which the refrigerant in the refrigerant circuit (21) flows. The refrigerant circuit (21) includes: the switching mechanism (26) configured to switch between the first refrigeration cycle in which the refrigerant dissipates heat in the second channel (25*b*) in the first operation and the second refrigeration cycle in which the refrigerant evaporates in the second channel (25*b*) in the second operation; and the channel regulating mechanism (30) configured to allow the refrigerant to flow in the second channel (25*b*) in the same direction during the first operation and the second operation.

According to the first feature of Variation E, the refrigerant flows through the second channel (25*b*) in the same direction during the heating operation and the cooling operation. During the heating operation, the temperature tends to increase at an inlet of the second channel (25*b*) of the utilization heat exchanger (25). This is because the superheated refrigerant flows through the inlet of the second channel (25*b*). For this reason, the scale is likely to generate around the inlet of the first channel (25*a*). Thus, it is preferable to quickly lower the temperature at the inlet in the cooling operation.

The direction of the refrigerant flowing in the second channel (25*b*) of the utilization heat exchanger (25) during the cooling operation is the same as the direction during the heating operation. Thus, the inlet having the highest temperature can be cooled by the refrigerant having the lowest temperature. It is preferable to keep a sufficient degree of subcooling of the condensed refrigerant in the heat source heat exchanger (23) during the cooling operation.

In the example described above, the controller (80) operates the water pump (53) during the cooling operation. However, the controller (80) may stop the water pump (53) during the cooling operation in the same manner as in Variation C. When the water pump (53) stops, the temperature around the inlet of the first channel (25*a*) can be lowered more quickly.

—Variation F (Water Supply Unit and Drainage Unit)—

The heat source device (20) of each of the embodiments described above may include a water supply unit and a drainage unit.

Figure 22:
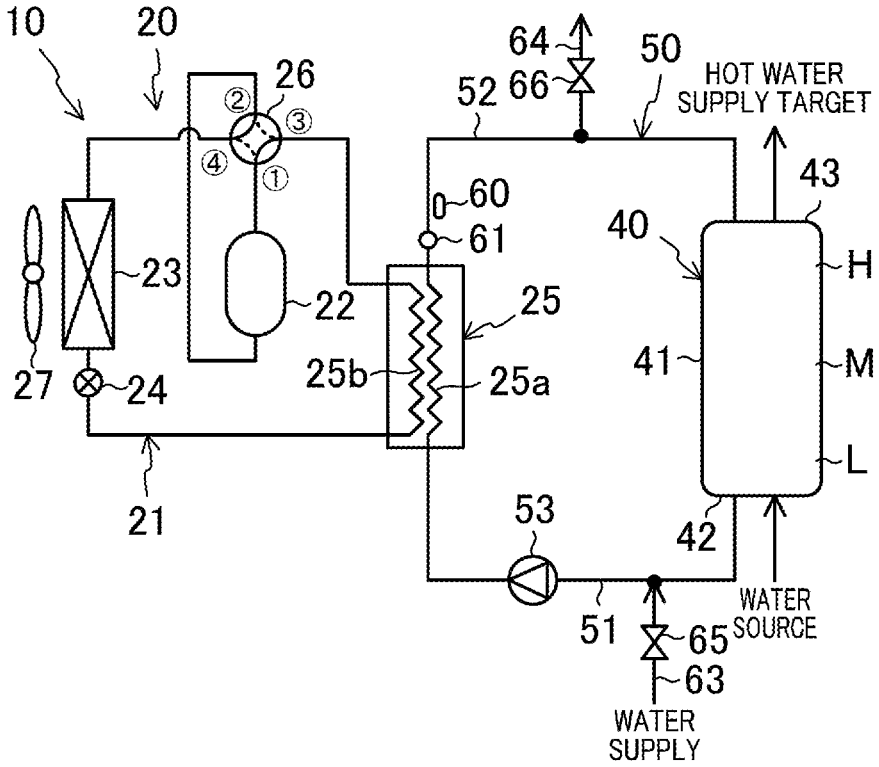
FIG. 22 is a schematic piping system diagram of a hot water supply apparatus according to Variation F.

As illustrated in FIG. 22, a water supply pipe (63) serving as the water supply unit and a drain pipe (64) serving as the drainage unit are connected to the water circuit (50). The water supply pipe (63) is connected to the upstream channel (51). The water supply pipe (63) is connected to the upstream side of the water pump (53). The water supply pipe (63) may be connected to the downstream side of the water pump (53). The water supply pipe (63) constitutes a supply unit for supplying the low-temperature water from the water source to the second channel (25*b*) of the utilization heat exchanger (25). The drain pipe (64) is connected to the downstream channel (52). In some of the embodiments described above having the first three-way valve (54) in the downstream channel (52), the drain pipe (64) is preferably connected to the upstream side of the first three-way valve (54).

In the cooling operation of Variation F, the controller (80) opens a first control valve (65) and a second control valve (66). Thus, the water is supplied from the water supply pipe (63) to the upstream channel (51). At the same time, the water in the second channel (25*b*) of the utilization heat exchanger (25) is drained outside the water circuit (50) through the drain pipe (64).

The water supply unit may be configured to supply the water from the water source via the tank (40).

—Advantages of Variation F—

As a first feature of Variation F, the water circuit (50) includes the water supply unit (63) configured to supply the water to the water circuit (50) in the second operation, and the drainage unit (64) configured to drain the water from the water circuit (50) in the second operation.

According to the first feature of Variation F, the scale remaining in the water circuit (50) can be discharged outside the water circuit (50) in the cooling operation. The scale peeled off the inner wall of the second channel (25*b*) can be discharged outside the water circuit (50).

As a second feature of Variation F, the hot water supply apparatus includes the supply unit (51, 63) configured to supply the low-temperature water to the first channel (25*a*) of the heat exchanger (25) in the second operation.

According to the second feature of Variation F, the low-temperature water can be supplied from the water supply pipe (63) serving as the supply unit to the second channel (25*b*). Thus, the temperature of the water in the second channel (25*b*) and the downstream channel (52) can be quickly lowered in the cooling operation.

—Variation G (Collector)—

The heat source device (20) of each of the embodiments described above may include a collector (67) that collects the scale.

Figure 23:
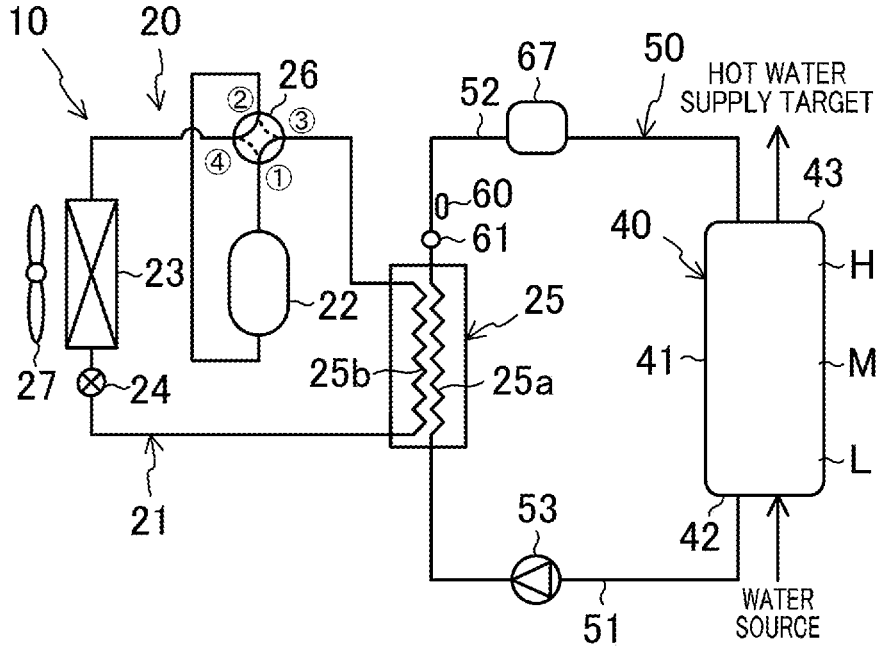
FIG. 23 is a schematic piping system diagram of a hot water supply apparatus according to Variation G.

As illustrated in FIG. 23, the water circuit (50) is provided with the collector (67). The collector (67) is connected to the downstream channel (52) of the water circuit (50). In some of the embodiments described above having the first three-way valve (54) in the downstream channel (52), the collector (67) is preferably connected to the upstream side of the first three-way valve (54). The collector may be a member having a net that captures the scale such as a strainer, or a member having a large surface area that accelerates the deposition of the scale.

In the cooling operation of Variation G, the collector (67) can collect the scale remaining in the water circuit (50). The scale peeled off the inner wall of the second channel (25*b*) can be collected on the collector (67).

Other Embodiments

The above-described embodiments and variations may be modified in the following manner.

Any type of the heat source device (20) may be used as long as it can heat and cool the water in the water circuit (50). The heat source device (20) may be an absorption heat pump device, an adsorption heat pump device, a magnetic refrigeration heat pump device, or a Peltier element.

The controller (80) may include a first controller for the heat source device (20) and a second controller for the water circuit (50).

While the embodiments and variations thereof have been described above, it will be understood that various changes in form and details may be made without departing from the spirit and scope of the claims. The embodiments, the variations, and the other embodiments may be combined and substituted with each other without deteriorating intended functions of the present disclosure. The expressions of "first," "second," and "third" described above are used to distinguish the terms to which these expressions are given, and do not limit the number and order of the terms.

INDUSTRIAL APPLICABILITY

The present disclosure is useful for a hot water supply apparatus.

EXPLANATION OF REFERENCES

10 Hot Water Supply Apparatus
20 Heat Source Device
21 Refrigerant Circuit
25 Utilization Heat Exchanger (Heat Exchanger)
25*a* First Channel
25*b* Second Channel
26 Four-Way Switching Valve (Switching Mechanism)
30 Channel Regulating Mechanism
40 Tank
50 Water Circuit
51 Upstream Channel (Supply Unit)
53 Water Pump (First Pump)

58 Low-Temperature Water Returning Channel
62 Scale Detector
63 Water Supply Pipe (Water Supply Unit)
64 Drain Pipe (Drainage Unit)
70 Heating Medium Circuit
71 Circulation Pump (Second Pump)
80 Controller
H High-Temperature Portion (First Portion)
M Medium-Temperature Portion (Second Portion)
L Low-Temperature Portion (Second Portion)

The invention claimed is:

1. A hot water supply apparatus, comprising:
a heat source device;
a tank configured to store water;
a water circuit through which the water in the tank circulates;
a heat exchanger having a first channel connected to the water circuit; and
a controller configured to control the heat source device and the water circuit, wherein
the controller is configured to perform:
a first operation in which the heat source device directly or indirectly heats the water in the first channel of the heat exchanger; and
a second operation in which the heat source device directly or indirectly cools the water in the first channel of the heat exchanger to a temperature which is lower than or equal to a temperature at which scale precipitates after the first operation ends, and
the controller is configured to perform a first determination of whether to perform the second operation according to an amount of scale in the water circuit in the course of the first operation.

2. The hot water supply apparatus of claim 1, wherein
the controller is configured to determine in the first determination whether to perform the second operation based on at least an integrated value of an operation time of the first operation.

3. The hot water supply apparatus of claim 1, further comprising
a detector configured to detect an index corresponding to the amount of the scale in the water circuit, wherein
the controller is configured to determine in the first determination whether to perform the second operation based on a detection value of the detector.

4. The hot water supply apparatus of claim 1, wherein
the controller is configured to perform the second operation every time the first operation ends.

5. The hot water supply apparatus of claim 1, wherein
the water circuit has a first pump that circulates the water in the water circuit, and
the controller is configured to operate the first pump in the second operation.

6. The hot water supply apparatus of claim 5, wherein
the water circuit includes a bypass section that forms a channel through which the water cooled in the first channel of the heat exchanger bypasses the tank and returns to the first channel in the second operation.

7. The hot water supply apparatus of claim 5, wherein
the water circuit includes a low-temperature water returning channel that returns the water cooled in the first channel of the heat exchanger to a low-temperature portion of the tank in the second operation.

8. The hot water supply apparatus of claim 1, wherein
the water circuit has a first pump that circulates water, and
the controller is configured to stop the first pump in the second operation.

9. The hot water supply apparatus of claim 1, wherein
the heat exchanger has a second channel through which a heating medium that exchanges heat with the water flowing through the first channel flows,
the hot water supply apparatus further includes a heating medium circuit including the second channel and a second pump and allowing the heating medium to circulate,
the first operation is an operation in which the heat source device heats the heating medium in the heating medium circuit and the heated heating medium heats the water in the first channel, and
the second operation is an operation in which the heat source device cools the heating medium in the heating medium circuit and the cooled heating medium cools the water in the first channel.

10. The hot water supply apparatus of claim 1, wherein
the heat source device has a refrigerant circuit in which a refrigerant circulates to cause a refrigeration cycle,
the heat exchanger has a second channel through which the refrigerant in the refrigerant circuit flows, and
the refrigerant circuit includes:
a switching mechanism configured to switch between a first refrigeration cycle in which the refrigerant dissipates heat in the second channel in the first operation and a second refrigeration cycle in which the refrigerant evaporates in the second channel in the second operation; and
a channel regulating mechanism configured to allow the refrigerant to flow in the second channel in the same direction during the first operation and the second operation.

11. The hot water supply apparatus of claim 1, wherein
the water circuit includes:
a water supply unit configured to supply water to the water circuit in the second operation; and
a drainage unit configured to drain the water from the water circuit in the second operation.

12. A hot water supply apparatus, comprising:
a heat source device;
a tank configured to store water;
a water circuit through which the water in the tank circulates;
a heat exchanger having a first channel connected to the water circuit; and
a controller configured to control the heat source device and the water circuit, wherein
the controller is configured to perform:
a first operation in which the heat source device directly or indirectly heats the water in the first channel of the heat exchanger; and
a second operation in which the heat source device directly or indirectly cools the water in the first channel of the heat exchanger after the first operation ends,
the controller is configured to perform a first determination of whether to perform the second operation according to an amount of scale in the water circuit in the course of the first operation,
the controller is configured to determine in the first determination whether to perform the second operation based on at least an integrated value of an operation time of the first operation, and
the controller is configured to perform the second operation when it is determined in the first determination that an integrated value, which is based on the operation time of the first operation, a temperature of the water in the water circuit, and a pressure of the water in the water circuit, exceeds a predetermined value.

13. A hot water supply apparatus, comprising:

a heat source device;

a tank configured to store water;

a water circuit through which the water in the tank circulates;

a heat exchanger having a first channel connected to the water circuit; and a controller configured to control the heat source device and the water circuit, wherein the controller is configured to perform:

a first operation in which the heat source device directly or indirectly heats the water in the first channel of the heat exchanger; and a second operation in which the heat source device directly or indirectly cools the water in the first channel of the heat exchanger to a temperature which is lower than or equal to a temperature at which scale precipitates after the first operation ends, and the controller is configured to perform a second determination of whether to end the second operation according to an amount of scale in the water circuit in the course of the second operation.

14. The hot water supply apparatus of claim 13, wherein the controller is configured to end the second operation when it is determined in the second determination that a temperature of the water in the water circuit falls below a predetermined value in the second operation.

15. The hot water supply apparatus of claim 13, wherein the controller is configured to determine in the second determination whether to end the second operation based on at least an operation time of the second operation.

16. The hot water supply apparatus of claim 13, further comprising:

a detector configured to detect an index related to the amount of the scale in the water circuit, wherein the controller is configured to determine in the second determination whether to end the second operation based on a detection value of the detector.

17. A hot water supply apparatus, comprising:

a heat source device;

a tank configured to store water;

a water circuit through which the water in the tank circulates;

a heat exchanger having a first channel connected to the water circuit; and a controller configured to control the heat source device and the water circuit, wherein the controller is configured to perform:

a first operation in which the heat source device directly or indirectly heats the water in the first channel of the heat exchanger; and a second operation in which the heat source device directly or indirectly cools the water in the first channel of the heat exchanger after the first operation ends, the controller is configured to perform a second determination of whether to end the second operation according to an amount of scale in the water circuit in the course of the second operation, the controller is configured to determine in the second determination whether to end the second operation based on at least an operation time of the second operation, and the controller is configured to end the second operation when it is determined in the second determination that a value, which is based on the operation time of the second operation, a temperature of the water in the water circuit, and a pressure of the water in the water circuit, falls below a predetermined value.

18. A hot water supply apparatus, comprising:

a heat source device;

a tank configured to store water;

a water circuit through which the water in the tank circulates;

a heat exchanger having a first channel connected to the water circuit; and a controller configured to control the heat source device and the water circuit, wherein the controller is configured to perform:

a first operation in which the heat source device directly or indirectly heats the water in the first channel of the heat exchanger; and a second operation in which the heat source device directly or indirectly cools the water in the first channel of the heat exchanger to a temperature which is lower than or equal to a temperature at which scale precipitates after the first operation ends, the controller is configured to perform a first determination of whether to perform the second operation according to an amount of scale in the water circuit in the course of the first operation, and the hot water supply apparatus further includes a supply unit configured to supply low-temperature water to the first channel of the heat exchanger in the second operation.

19. A hot water supply apparatus, comprising:

a heat source device;

a tank configured to store water;

a water circuit through which the water in the tank circulates;

a heat exchanger having a first channel connected to the water circuit; and a controller configured to control the heat source device and the water circuit, wherein the controller is configured to perform:

a first operation in which the heat source device directly or indirectly heats the water in the first channel of the heat exchanger; and a second operation in which the heat source device directly or indirectly cools the water in the first channel of the heat exchanger after the first operation ends, the controller is configured to perform a first determination of whether to perform the second operation according to an amount of scale in the water circuit in the course of the first operation, the water circuit has a first pump that circulates the water in the water circuit, the controller is configured to operate the first pump in the second operation, and the water circuit includes a channel changing section that returns the water cooled in the first channel of the heat exchanger to one of portions having different water temperatures in the tank according to a temperature of the water in the water circuit in the second operation.

20. The hot water supply apparatus of claim 19, wherein the channel changing section is configured to:

return the water cooled in the first channel of the heat exchanger to a first portion of the tank when the temperature of the water in the water circuit is higher than a first value in the second operation; and return the water cooled in the first channel of the heat exchanger to a second portion of the tank having a lower temperature than the first portion when the temperature of the water in the water circuit is lower than a second value equal to or less than the first value in the second operation.

* * * * *